US007439840B2

(12) United States Patent
Carastro et al.

(10) Patent No.: US 7,439,840 B2
(45) Date of Patent: Oct. 21, 2008

(54) METHODS AND APPARATUSES FOR HIGH-PERFORMING MULTI-LAYER INDUCTORS

(75) Inventors: Lawrence A. Carastro, Marietta, GA (US); Semyon Lapushin, Tucker, GA (US); Sidharth Dalmia, Norcross, GA (US); Winston Czakon, Atlanta, GA (US); George White, Marietta, GA (US)

(73) Assignee: Jacket Micro Devices, Inc., Atlanta, GA (US)

( * ) Notice: Subject to any disclaimer, the term of this patent is extended or adjusted under 35 U.S.C. 154(b) by 57 days.

(21) Appl. No.: 11/426,923

(22) Filed: Jun. 27, 2006

(65) Prior Publication Data

US 2007/0296534 A1 Dec. 27, 2007

(51) Int. Cl.
*H01F 5/00* (2006.01)
*H01F 7/06* (2006.01)

(52) U.S. Cl. ..... 336/200; 336/223; 336/232; 29/602.1

(58) Field of Classification Search ..... 336/200, 336/223, 232; 29/602.1, 605, 606
See application file for complete search history.

(56) References Cited

U.S. PATENT DOCUMENTS

| | | | |
|---|---|---|---|
| 4,745,215 | A | 5/1988 | Cox et al. |
| 4,824,381 | A | 4/1989 | Hertzberg et al. |
| 5,106,461 | A | 4/1992 | Volfson et al. |

(Continued)

FOREIGN PATENT DOCUMENTS

| | | |
|---|---|---|
| EP | 0 506 476 | 3/1992 |
| EP | 0 510 971 | 4/1992 |
| EP | 0 645 952 | 9/1994 |
| EP | 1 235 235 | 2/2002 |
| EP | 1 411 553 | 4/2004 |
| JP | 09 130103 | 10/1995 |
| WO | WO 01/95679 | 12/2001 |
| WO | WO 01/97582 | 12/2001 |

OTHER PUBLICATIONS

Alvin, L. S. Loke, et al., "Evaluation of Copper Penetration in Low-κ Polymer Dielectrics by Bias-Temperature Stress," MRS Spring Meeting, Symposium N/o, Paper O4.4, San Francisco, CA, Apr. 7, 1999.

(Continued)

*Primary Examiner*—Anh T Mai
(74) *Attorney, Agent, or Firm*—Sutherland Asbill & Brennan LLP

(57) ABSTRACT

Embodiments of the present invention may provide for high-performing inductor structures utilizing multi-layer organic stackups. In particular, these high-performing inductor structures may be formed of one or more stitched metal layer building blocks, which are each formed of at least two inductor sections that are vertically or horizontally aligned, and then stitched or connected together. This stitching process significantly reduces the DC/RF losses while reducing the inductance value by a substantially lower factor, thereby significant increasing the Q-factor of the resulting inductor structure. Each stitched metal layer building block may be formed on an organic dielectric layer (e.g., liquid crystalline polymer (LCP)) having a first conductive layer on a first surface and perhaps a second conductive layer on a second surface opposite the first surface. The at least two inductor sections described above may be formed by patterning or circuitizing the first conductive layer and/or the second conductive layer. Additional stitched metal layer building blocks may be stacked with at least one organic laminate layer (e.g., LCP) disposed between each pair of stitched metal layer building blocks. Plated vias may be utilized to connect one stitched metal layer building block with another stitched metal layer building block to form a resulting high-performing inductor structure.

20 Claims, 20 Drawing Sheets

U.S. PATENT DOCUMENTS 5,162,257 A 11/1992 Yung
5,247,377 A 9/1993 Omeis et al.
5,270,493 A 12/1993 Inoue et al.
5,323,128 A 6/1994 Ishizaki et al.
5,329,695 A 7/1994 Traskos et al.
5,349,314 A 9/1994 Shimizu et al.
5,373,271 A 12/1994 Hirai et al.
5,384,434 A 1/1995 Mandai et al.
5,396,201 A 3/1995 Ishizaki et al.
5,401,913 A 3/1995 Gerber et al.
5,416,454 A 5/1995 McVeety
5,450,290 A 9/1995 Boyko et al.
5,497,337 A 3/1996 Ponnapalli et al.
5,517,751 A 5/1996 Bross et al.
5,521,564 A 5/1996 Kaneko et al.
5,532,667 A 7/1996 Haertling et al.
5,545,916 A 8/1996 Koullias
5,559,360 A 9/1996 Chiu et al.
5,610,433 A 3/1997 Merrill et al.
5,635,892 A 6/1997 Ashby et al.
5,652,561 A * 7/1997 Inoh et al. ..... 336/200
5,654,681 A 8/1997 Ishizaki et al.
5,668,511 A 9/1997 Furutani et al.
5,679,414 A 10/1997 Akashi et al.
5,703,544 A 12/1997 Hays, III
5,716,663 A 2/1998 Capote et al.
5,719,354 A 2/1998 Jester et al.
5,719,539 A 2/1998 Ishizaki et al.
5,720,898 A 2/1998 Nohira et al.
5,739,193 A 4/1998 Walpita et al.
5,770,986 A 6/1998 Tonegawa et al.
5,801,100 A 9/1998 Lee et al.
5,818,313 A 10/1998 Estes et al.
5,844,299 A 12/1998 Merrill et al.
5,917,244 A 6/1999 Lee et al.
5,955,931 A 9/1999 Kaneko et al.
5,999,243 A 12/1999 Kameyama et al.
6,005,197 A 12/1999 Kola et al.
6,008,102 A 12/1999 Alford et al.
6,021,050 A 2/2000 Ehman et al.
6,026,286 A 2/2000 Long
6,031,727 A 2/2000 Duesman et al.
6,040,226 A 3/2000 Wojnarowski et al.
6,051,289 A 4/2000 Tsujimoto et al.
6,079,100 A 6/2000 Farquhar et al.
6,093,599 A 7/2000 Lee et al.
6,114,925 A 9/2000 Lo
6,127,905 A 10/2000 Horie
6,153,290 A 11/2000 Sunahara
6,166,799 A 12/2000 Kameyama et al.
6,171,716 B1 1/2001 Sasaki et al.
6,177,853 B1 1/2001 Nagatomi et al.
6,191,666 B1 2/2001 Sheen
6,191,669 B1 2/2001 Shigemura
6,225,696 B1 5/2001 Hathaway et al.
6,249,962 B1 6/2001 Bergstedt
6,255,714 B1 7/2001 Kossives et al.
6,259,037 B1 7/2001 Feilchenfeld et al.
6,259,148 B1 7/2001 Bartush et al.
6,261,872 B1 7/2001 Hathaway et al.
6,281,430 B1 8/2001 Lupo et al.
6,287,931 B1 9/2001 Chen
6,303,423 B1 10/2001 Lin
6,333,469 B1 12/2001 Inoue et al.
6,380,608 B1 4/2002 Bentley
6,395,374 B1 5/2002 McAndrew et al.
6,421,225 B2 7/2002 Bergstedt
6,445,266 B1 9/2002 Nagatomi et al.
6,492,886 B1 12/2002 Kushitani et al.
6,528,732 B1 3/2003 Okubora et al.
6,583,687 B2 6/2003 Nosaka
6,586,686 B1 7/2003 Enomoto et al.
6,625,037 B2 9/2003 Nakatani et al.
6,713,162 B2 3/2004 Takaya et al.
6,759,600 B2 7/2004 Koyama et al.
6,900,708 B2 * 5/2005 White et al. ..... 333/185
2001/0004228 A1 6/2001 Hirai et al.
2001/0016980 A1 8/2001 Bergstedt
2001/0050599 A1 12/2001 Maekawa et al.
2002/0008301 A1 1/2002 Liou et al.
2002/0048930 A1 4/2002 Lin
2002/0064701 A1 5/2002 Hand et al.
2002/0064922 A1 5/2002 Lin
2002/0074158 A1 6/2002 St. Lawrence et al.
2002/0076538 A1 6/2002 St. Lawrence et al.
2002/0081443 A1 6/2002 Connelly et al.
2002/0157864 A1 10/2002 Koyama et al.
2002/0158305 A1 10/2002 Dalmia et al.
2002/0172021 A1 11/2002 Seri et al.
2002/0195270 A1 12/2002 Okubora et al.
2004/0034489 A1 2/2004 Ogino et al.
2004/0113752 A1 6/2004 Schuster et al.
2006/0180342 A1 * 8/2006 Takaya et al. ..... 174/256

OTHER PUBLICATIONS

Charles, H. K., "Packaging with Multichip Modules," 1992 IEEE/CHMT Int'l Electronics Manufacturing Technology Symposium, pp. 206-210.
Dalmia, S. et al., "Modeling RF Passive Circuits Using Coupled Lines and Scalable Models," 2001 Electronic Components and Technology Conference, pp. 816-823.
Hong, J. S. et al., "Microstrip Fitters for RF/Microwave Applications," Wiley-Interscience Publication, 2001, pp. 121-159.
Matijasevic, G. et al., "MCM-L Substrates Fabricated Using Patterned TLPS Conductive Composites." 1997, International Conference on Multichip Modules, Apr. 2, 1997, pp. 64-69.
Min, S. H. et al., "Design, Fabircation, Measurement and Modeling of Embedded Inductors in Laminate Technology," ASME International Electronic Packaging Technical Conference and Exhibition, Jul. 8-13, 2001, pp. 1-5.
Patent Abstracts of Japan vol. 1995, No. 9, Oct. 31, 1995.
Son, M. H. et al.., "Low-Cost Realization of ISM Band Pass Filters Using Integrated Combine Structures," 2000, (4 pages).
Wang, et al., "A Full-Wave Analysis Model for Uniplanar Circuits with Lumped Elements," IEEE Transactions on Microwave Theory and Techniques, vol. 51, No. 1, Jan. 2003.
www.sbir.gsfc.nasa.gov/SBIR/successes/ss/110text.html; Liquid Crystal Polymers for Printed Wiring Boards.
www.stneasy.org.tmp; Display from INSPEC; Taoka, M., Kanetaka, T., Dec. 4, 2002.
www.yamaichi.us/yflex.html; Flexible Printed Circuit.

* cited by examiner

METHODS AND APPARATUSES FOR HIGH-PERFORMING MULTI-LAYER INDUCTORS

BACKGROUND OF THE INVENTION

I. Field of the Invention

The present invention generally relates to passive devices, and more particularly to the design of high-performing inductors embedded in organic substrates.

II. Description of Related Art inductors are an important component of many passive and active devices. In particular, the quality factor (Q-factor) of the inductors used in filters, resonators, oscillators, and other passive and active devices is oftentimes an important parameter that may affect the performance characteristics (e.g., passband loss) of the filters as well as the phase noise in the resonators and oscillators. Thus, inductors with insufficient Q-factors in filters, resonators, and oscillators can result in degraded performance characteristics and/or phase noise. Fu her, some applications such as power amplifiers also require high Q-factors in addition to high current-carrying capabilities.

Current planar inductors have been unable to achieve the higher Q-factors and current-carrying capabilities provided by embodiments of the present invention. In particular, planar inductors have typically been created by metallization of silicon substrates as utilized in integrated circuits (IC) technology. These planar inductors have limited inductance values, and thus lower Q-factors, due to the area and volume restrictions. Further, even planar inductors with multiple metallization layers, as with U.S. Pat. No. 5,446,311, have been unable to achieve the higher Q-factors and current-carrying capabilities provided by embodiments of the present invention.

SUMMARY OF THE INVENTION

Embodiments of the present invention may provide for high-Q inductor structures in which multi-layer organic stackups are utilized. According to an embodiment of the present invention, there is an organic inductor. The organic inductor includes a first organic layer having a first surface and a second surface opposite the first surface and a first conductive layer on the first surface of the first organic layer, where the first conductive layer is patterned to form a first inductor section having a first connection point and a second connection point. In addition, the organic inductor includes a second conductive layer on the second surface of the first organic layer, where the second conductive layer is patterned to form a second inductor section having a first connection point and a second connection point. Furthermore, the organic inductor includes a first via connecting the first connection point of the first inductor section with the first connection point of the second inductor section and a second via connecting the second connection point of the first inductor section with the second connection point of the second inductor.

According to an aspect of the present invention, there may be a second organic layer having a first surface and a second surface opposite the first surface, an organic laminate layer disposed between the first organic layer and the second organic layer, and a third conductive layer on a first surface of the second organic layer, where the third conductive layer may be patterned to form a third inductor section having a first connection point and a second connection point. In addition, there may be a fourth conductive layer on a second surface of the second organic layer, where the fourth conductive layer may be patterned to form a fourth inductor section having a first connection point and a second connection point, where the second via may further connect the second connection point of the third inductor section and the second connection point of the fourth inductor section, and a third via connecting the first connection point of the third inductor section with the first connection point of the fourth inductor section, According to another aspect of the present invention, one or more of the first organic layer, the second organic layer, and the organic laminate layer may include liquid crystalline polymer (LCP). According to another aspect of the present invention, one or both of the first organic layer and the second organic layer may be low-loss. According to still another aspect of the invention, the first and second inductor sections may be substantially identical in shape, and the third and fourth inductor sections may be substantially identical in shape. For example, the shape may be one of spiral, loop, circular, and hexagonal. In addition, the first and second inductor sections may be vertically aligned, and the third and fourth inductor sections may be vertically aligned. According to yet another aspect of the present invention, the first, second, third, and fourth inductor sections may include one or more complete or partial turns.

According to another embodiment of the present invention, there is an organic inductor. The organic inductor includes a first organic layer having a first surface and a second surface opposite the first surface and a first conductive layer on the first surface of the first organic layer, where the first conductive layer is patterned to form a first inductor section having a first connection point and a second connection point, and a second inductor section having a first connection point and a second connection point. The organic inductor also includes a second conductive layer on the second surface of the first organic layer, where the second conductive layer may be patterned to form a third inductor section having a first connection point and a second connection point, and a fourth inductor section having a first connection point and a second connection point. In addition, the organic inductor includes at least one first via connecting the second connection points of the first inductor section, the second inductor section, the third inductor section, and the fourth inductor section. Further, the organic inductor includes at least one second via connecting the first connection point of the first inductor section and the first connection point of the third inductor section and at least one third via connecting the first connection point of the second inductor section and the first connection point of the fourth connection point.

According to an aspect of the present invention, the first inductor section and the third inductor section may be substantially identical in shape, and the second inductor section and the fourth inductor section may also be substantially identical in shape. The first inductor section and the third inductor section may be vertically aligned, and the second inductor section and the fourth inductor section may also be vertically aligned. According to another aspect of the present invention, the organic inductor may further include a second organic layer having a first surface and a second surface opposite the first surface, an organic laminate layer disposed between the first organic layer and the second organic layer, and a third conductive layer on the first surface of the second organic layer, where the third conductive layer is patterned to form a third inductor section having a first connection point and a second connection point. Likewise, the organic inductor may further include a fourth conductive layer on the second surface of the second organic layer, where the fourth conductive layer is patterned to form a fourth inductor section having a first connection point and a second connection point, at least one fourth via connecting the first connection point of the third inductor section and the first connection point of the fourth inductor section, and at least one fifth via connecting the second connection point of the third inductor section and the second connection point of the fourth inductor section. The at least one fifth via may provides a connection to either (i) the at least one first via or (ii) the at least one second via and the at least one third via. According to another aspect of the present invention, the first organic layer may include liquid crystalline polymer (LCP). Likewise, the second organic layer and the organic laminate layer may also include liquid crystalline polymer (LCP).

According to another embodiment of the present invention, there is a method for fabricating a high-performing inductor. The method includes providing a first organic layer having a first conductive layer on a first surface and a second conductive layer on a second surface opposite the first surface, circuitizing the first conductive layer to form a first inductor section having a first connection point and a second connection point, circuitizing the second conductive layer to form a second inductor section having a first connection point, establishing a first via connection between the first connection point of the first inductor section and the first connection point of the second inductor section, and establishing a second via connection between the second connection point of the first inductor section and the second connection point of the second inductor section.

According to an aspect of the present invention, the method may further include providing a second organic layer having a third conductive layer and a fourth conductive layer, circuitizing the third conductive layer to form a third inductor section having a first connection point and a second connection point, circuitizing the fourth conductive layer to form a fourth inductor section having a first connection point and a second connection point, and establishing a third via connection between the first connection point of the third inductor section and the first connection point of the fourth inductor section, where the second via connection further connects the second connection point of the third inductor section and the second connection point of the fourth inductor section. According to another aspect of the present invention, the first and second organic layers may include liquid crystalline polymer (LCP). According to yet another aspect of the present invention, the first and second inductor sections may be substantially identical in shape, and the first and second inductor sections may be vertically aligned. For example, the shape may be one of spiral, loop, circular, and hexagonal.

BRIEF DESCRIPTION OF THE SEVERAL VIEWS OF THE DRAWINGS

Figure 1A:
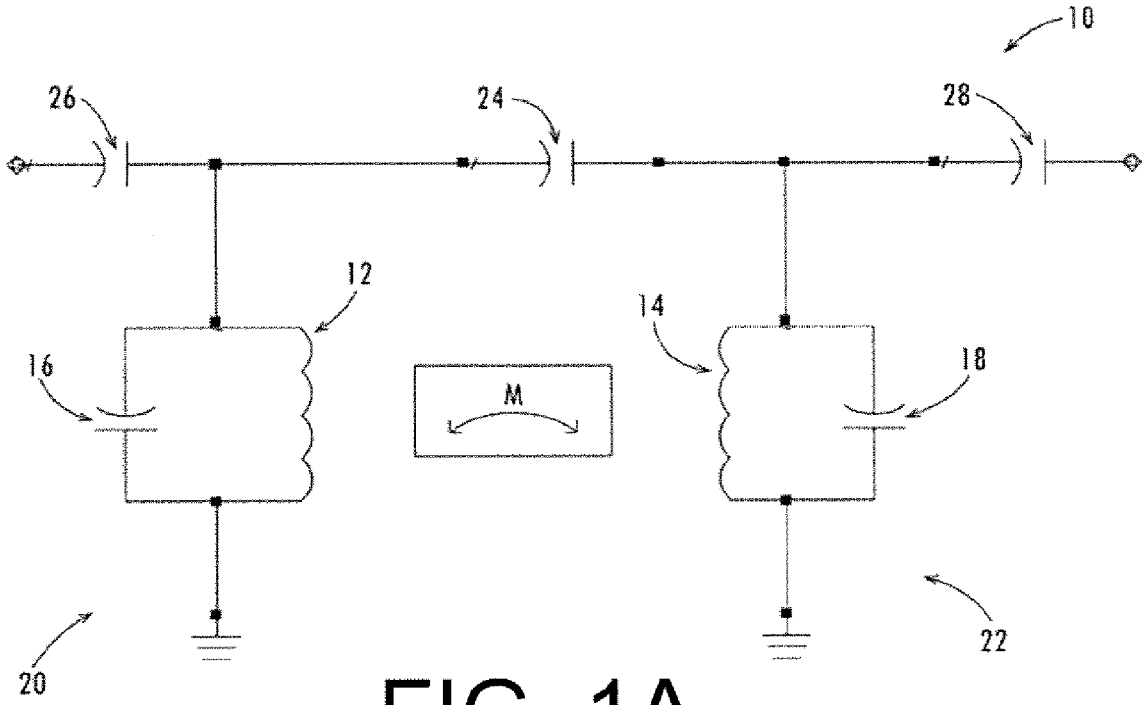

Having thus described the invention in general terms, reference will now be made to the accompanying drawings, which are not necessarily drawn to scale, and wherein:

FIG. 1A is a first equivalent circuit diagram for explaining the operation of the dielectric filters shown in FIGS. 2, 3 and 4.

Figure 1B:
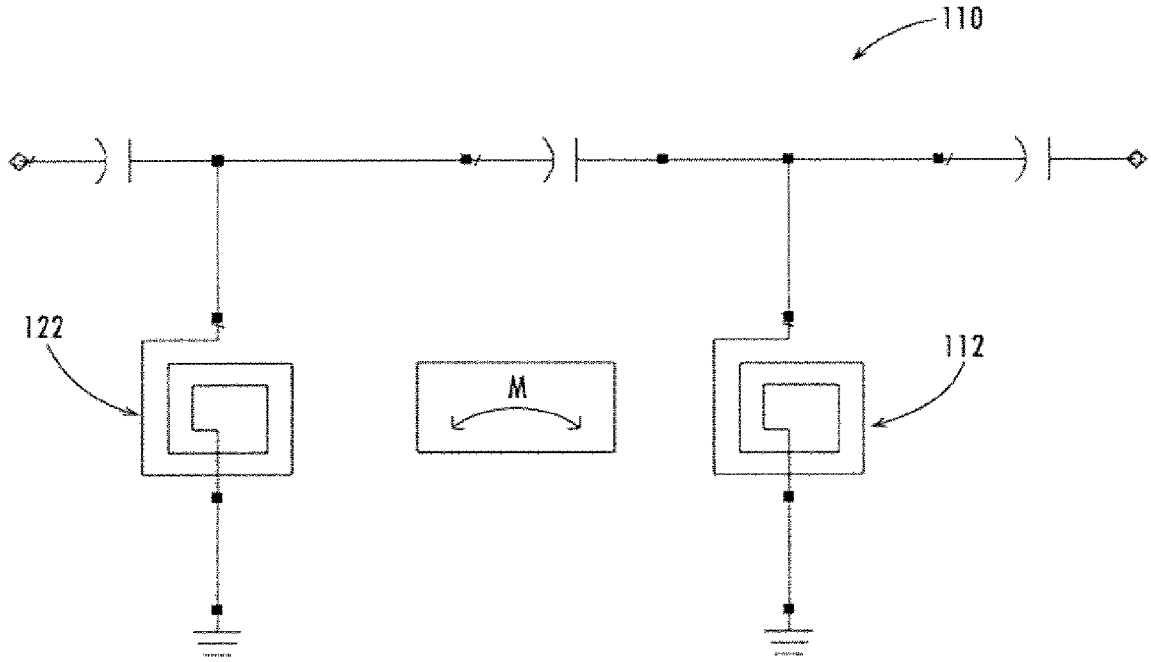

FIG. 1B is a second equivalent circuit diagram for explaining the operation of the dielectric filter of FIG. 1A using transmission lines or inductor resonator elements.

Figure 2A:
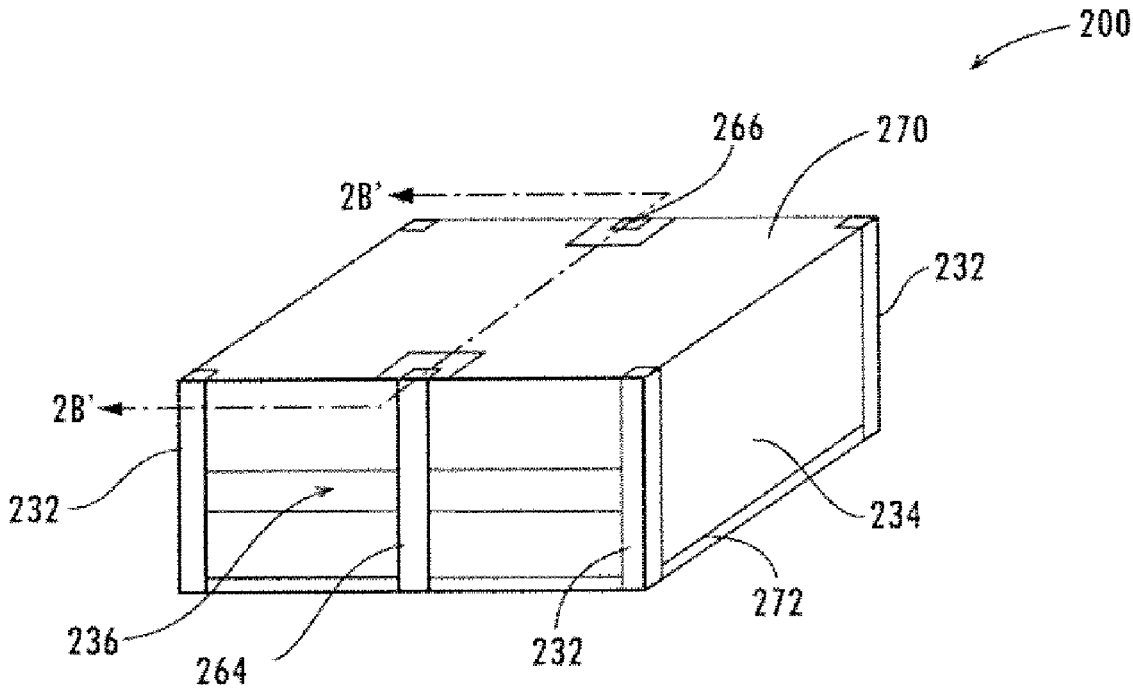
Figure 2B:
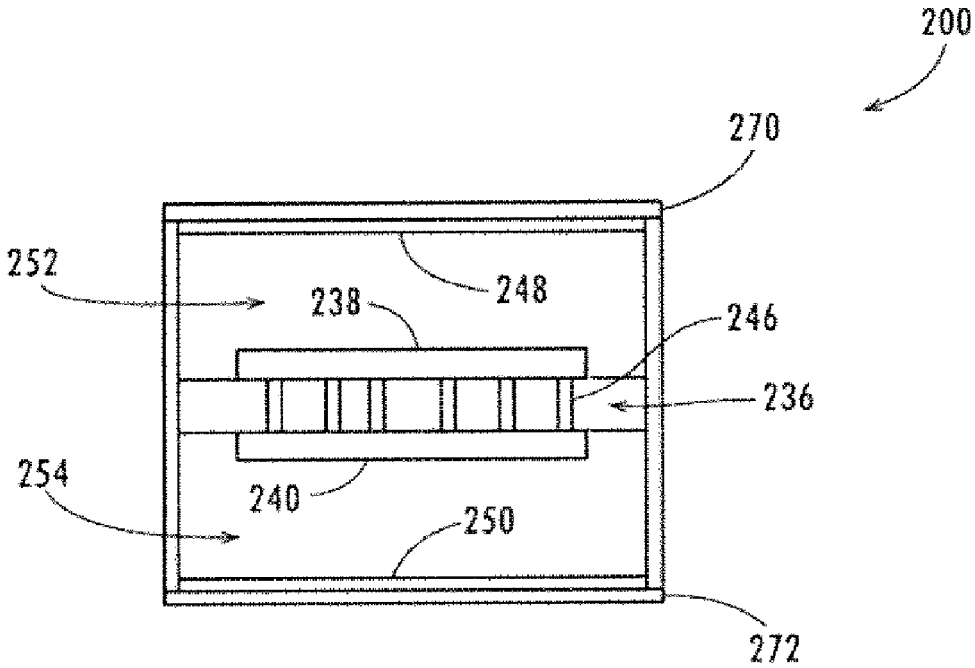
Figure 2C:
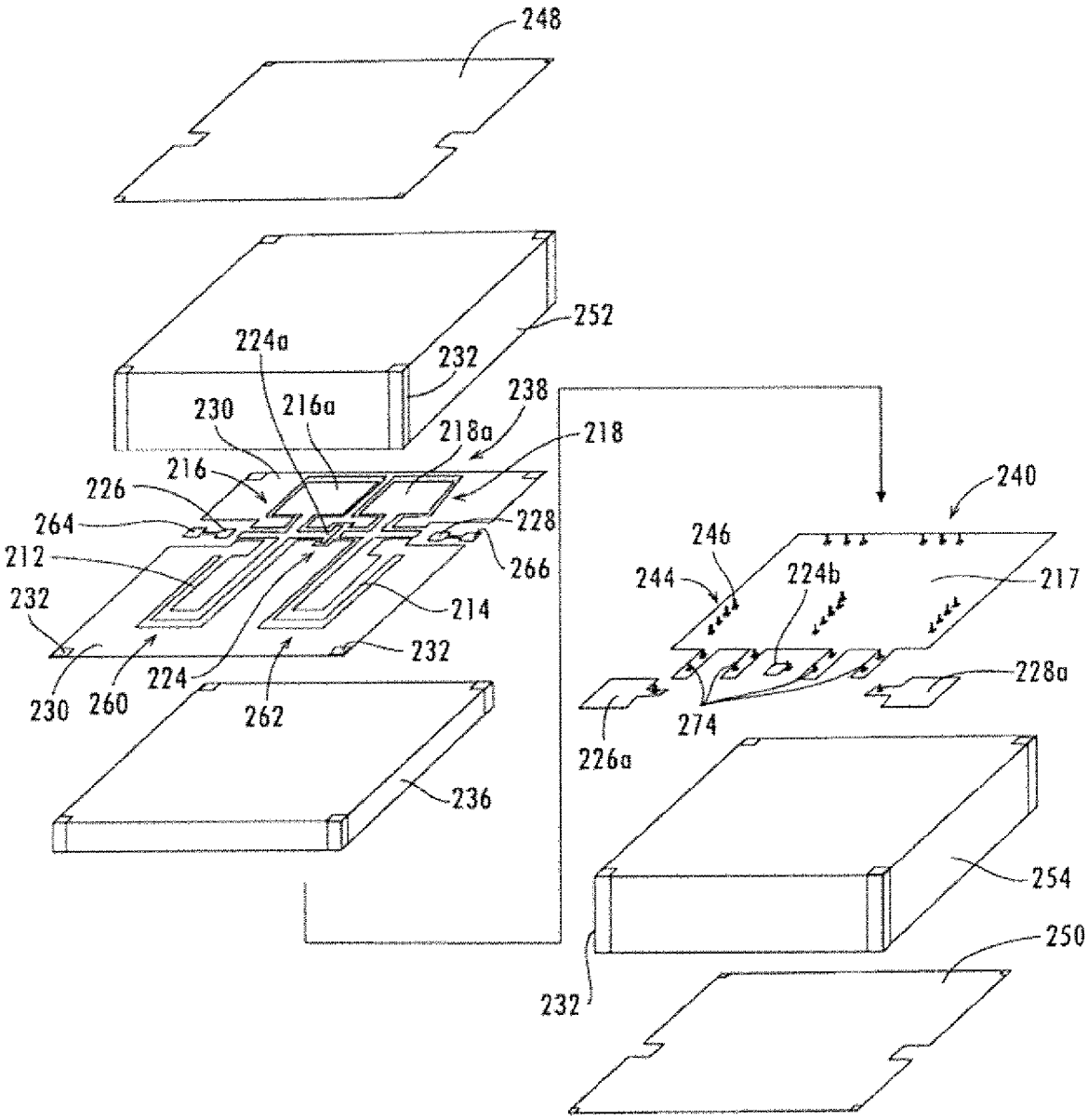

FIGS. 2A-2C show several views of a first organic dielectric filter according to an embodiment of the present invention.

Figure 3A:
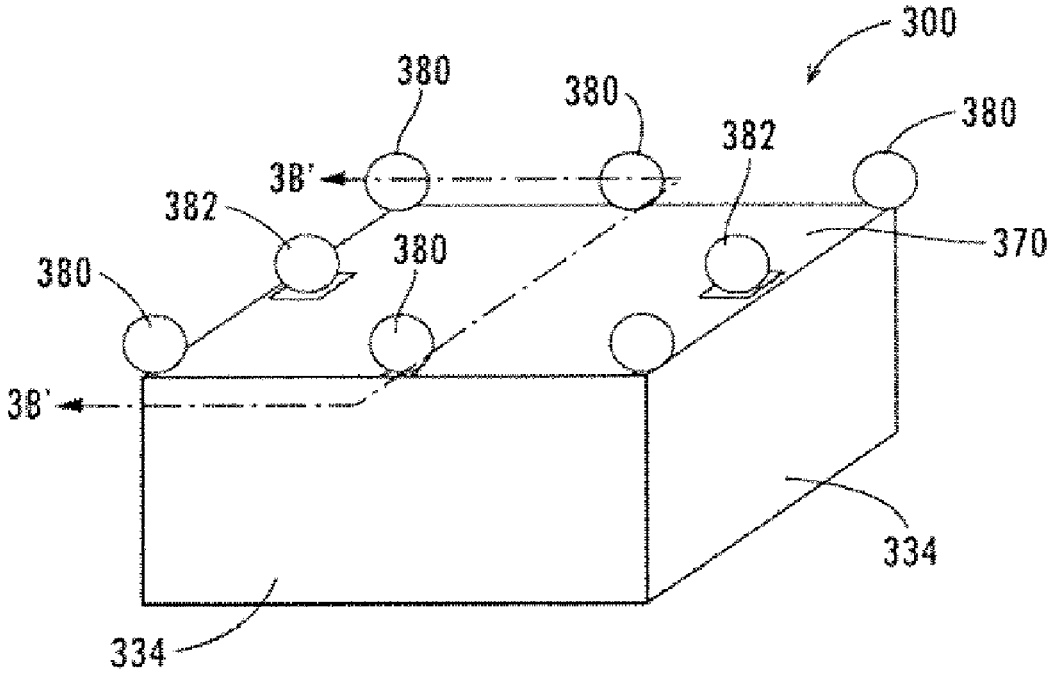
Figure 3B:
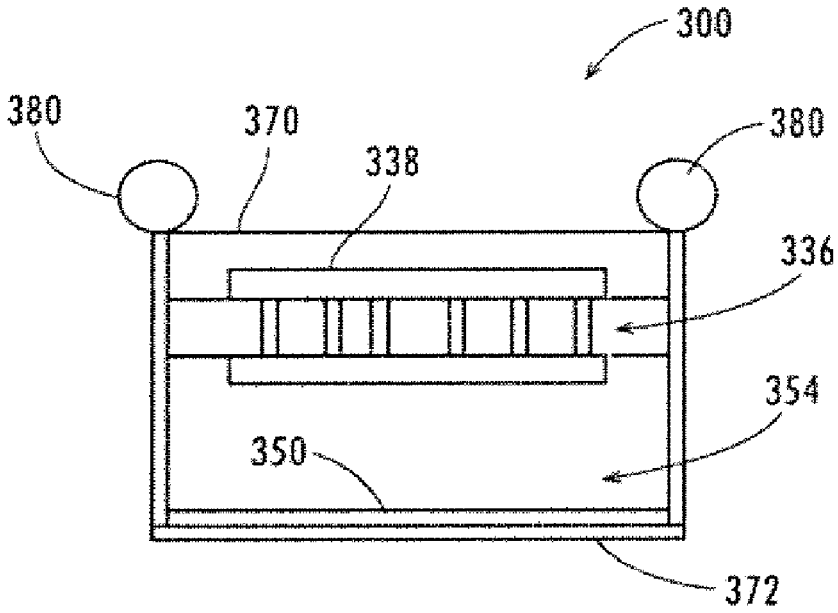
Figure 3C:
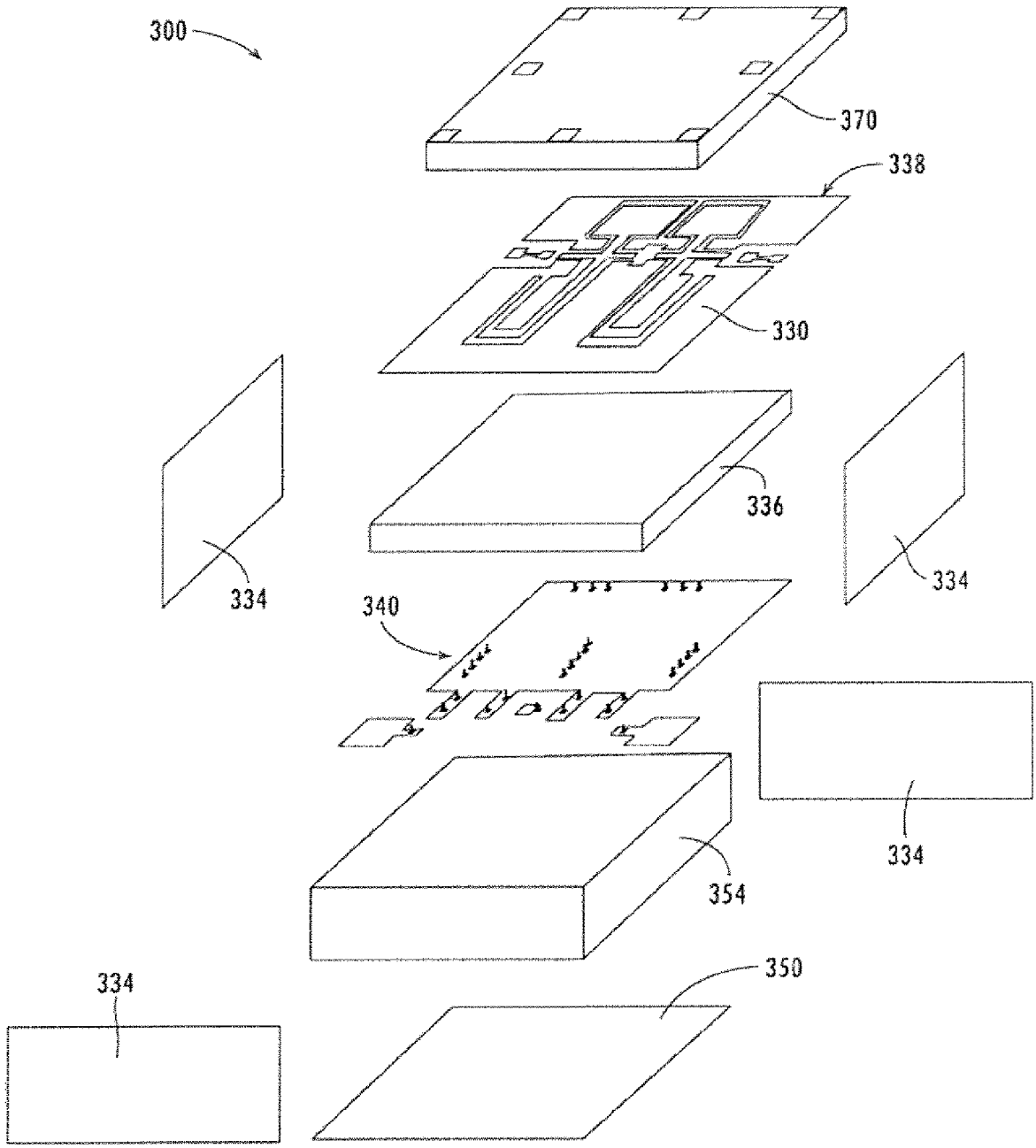

FIGS. 3A-3C show several views of a second organic dielectric filter according to an embodiment of the present invention.

Figure 4A:
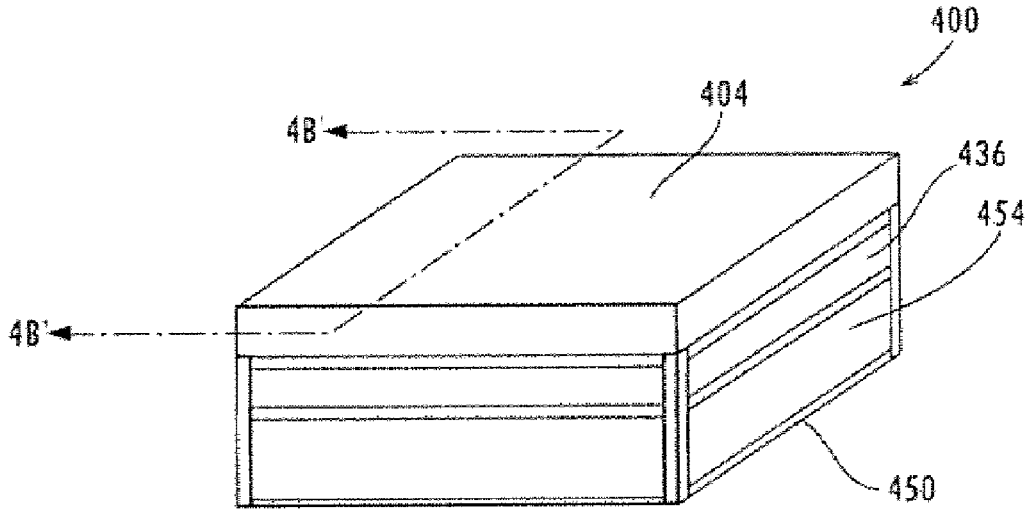
Figure 4B:
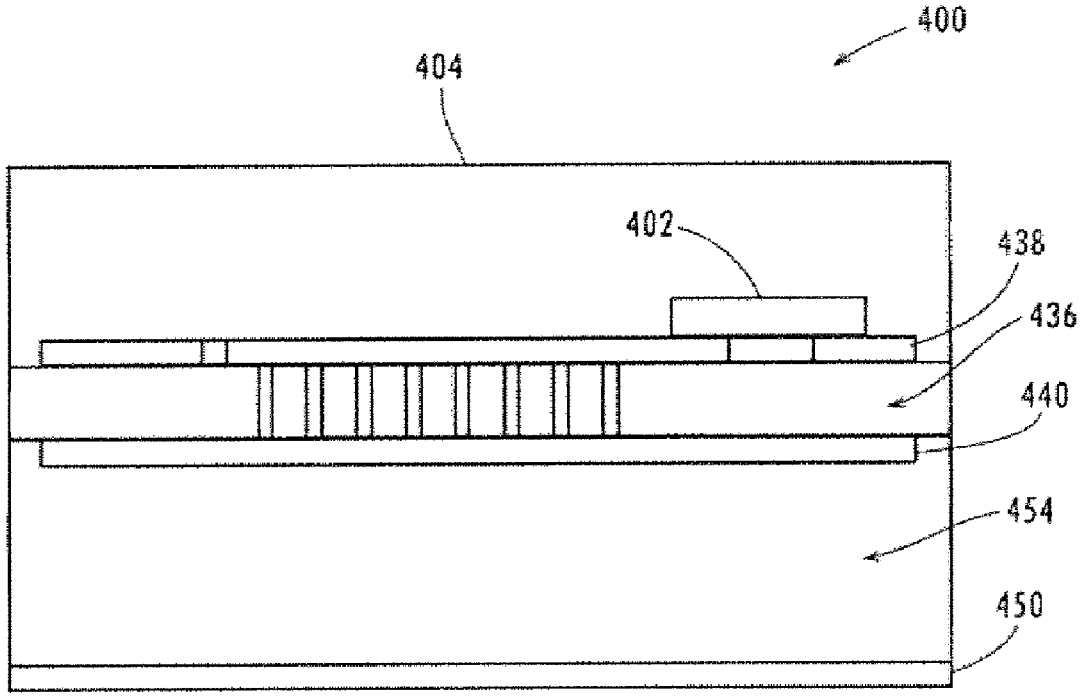

FIGS. 4A-4B show several views of a third organic dielectric filter according to an embodiment of the present invention.

Figure 5:
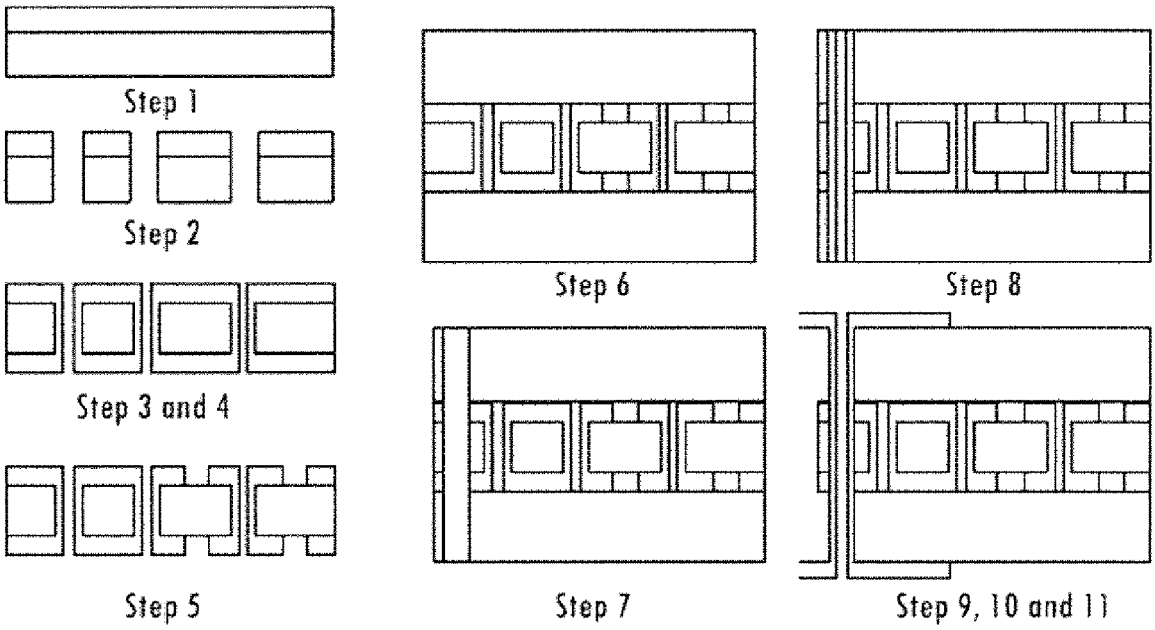

FIG. 5 illustrates a fabrication methodology for an organic dielectric filter according to the present invention, such as the first organic dielectric filter of FIGS. 2A-2C.

Figure 6:
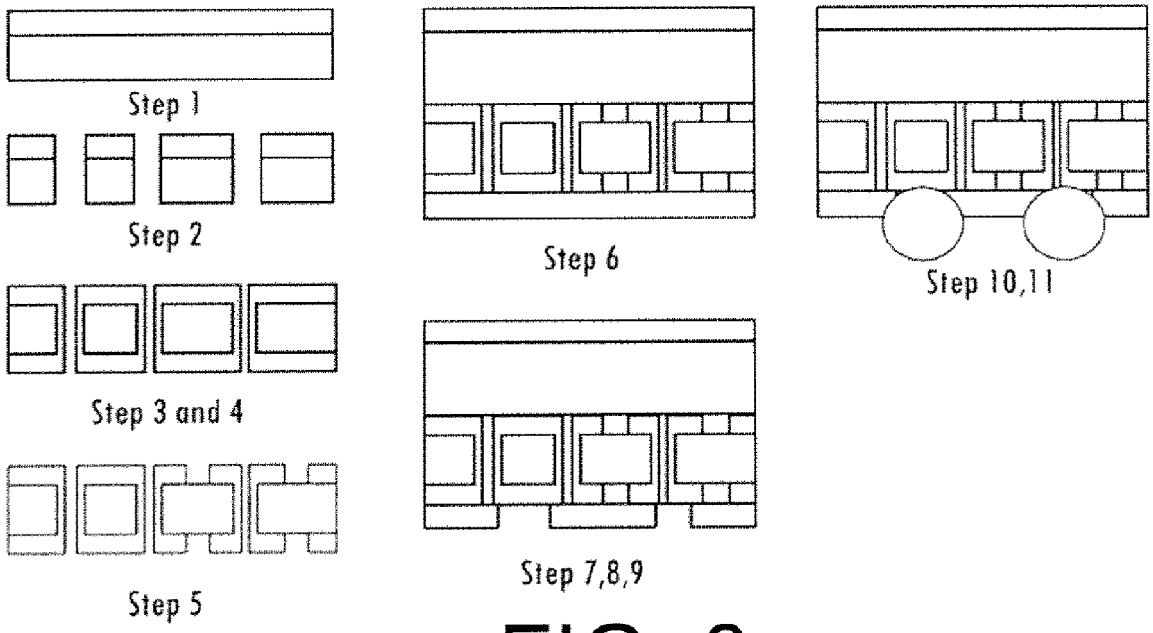

FIG. 6 illustrates a fabrication methodology for an organic dielectric filter according to the present invention, such as the organic dielectric filter of FIGS. 3A-3C.

Figure 7:
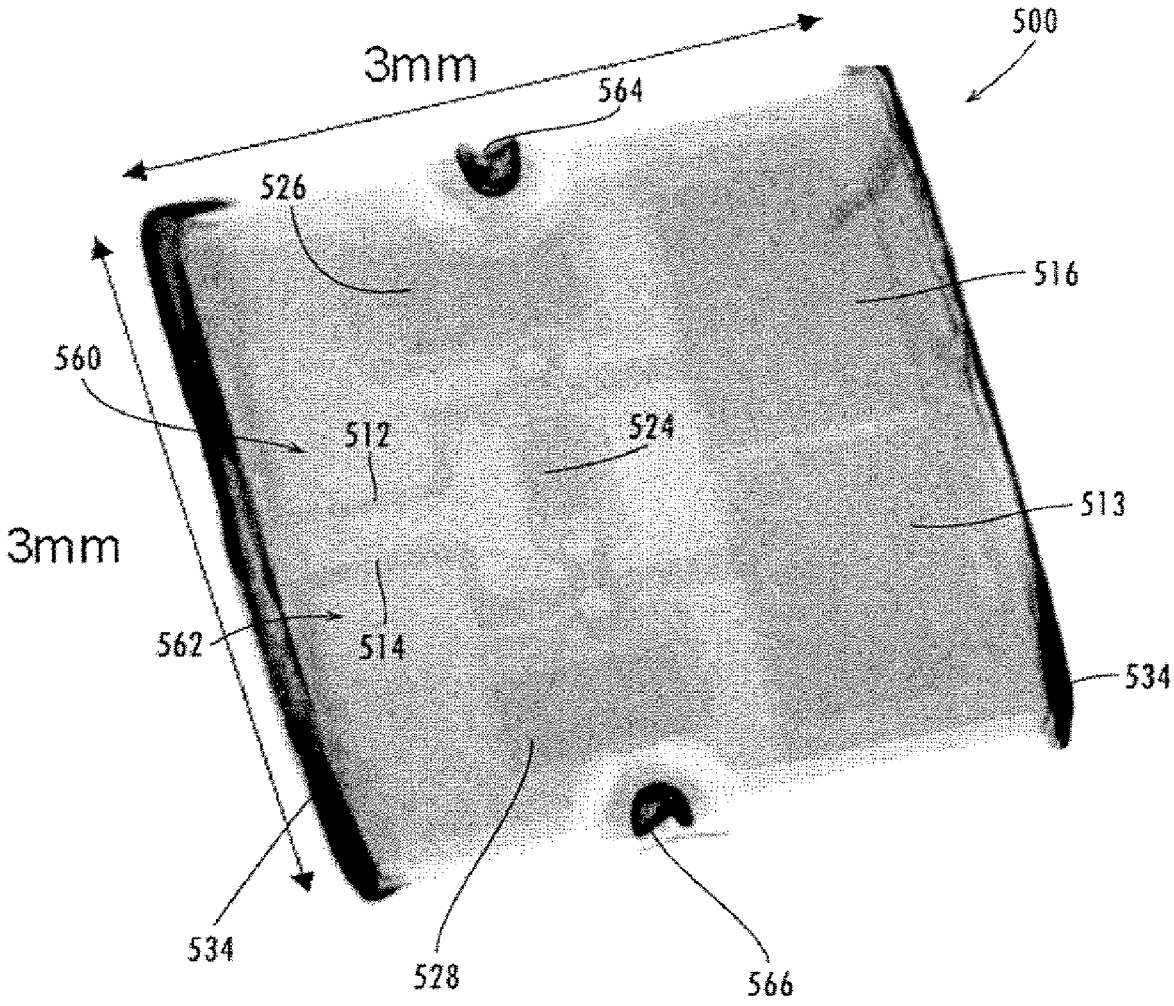

FIG. 7 is an X-ray from a top plan view of an organic bandpass filter in accordance with an embodiment of the present invention.

Figure 8:
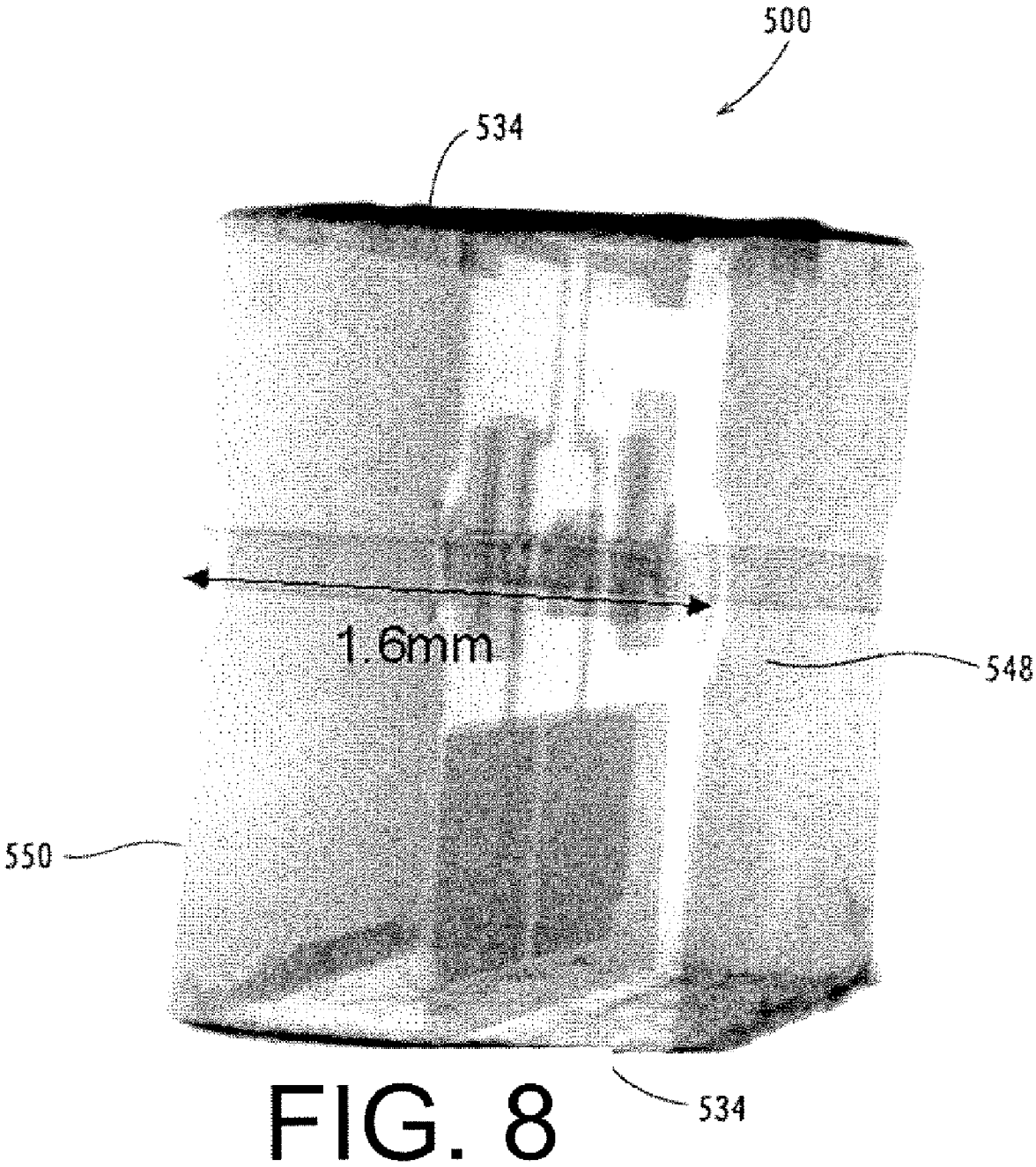
Figure 9:
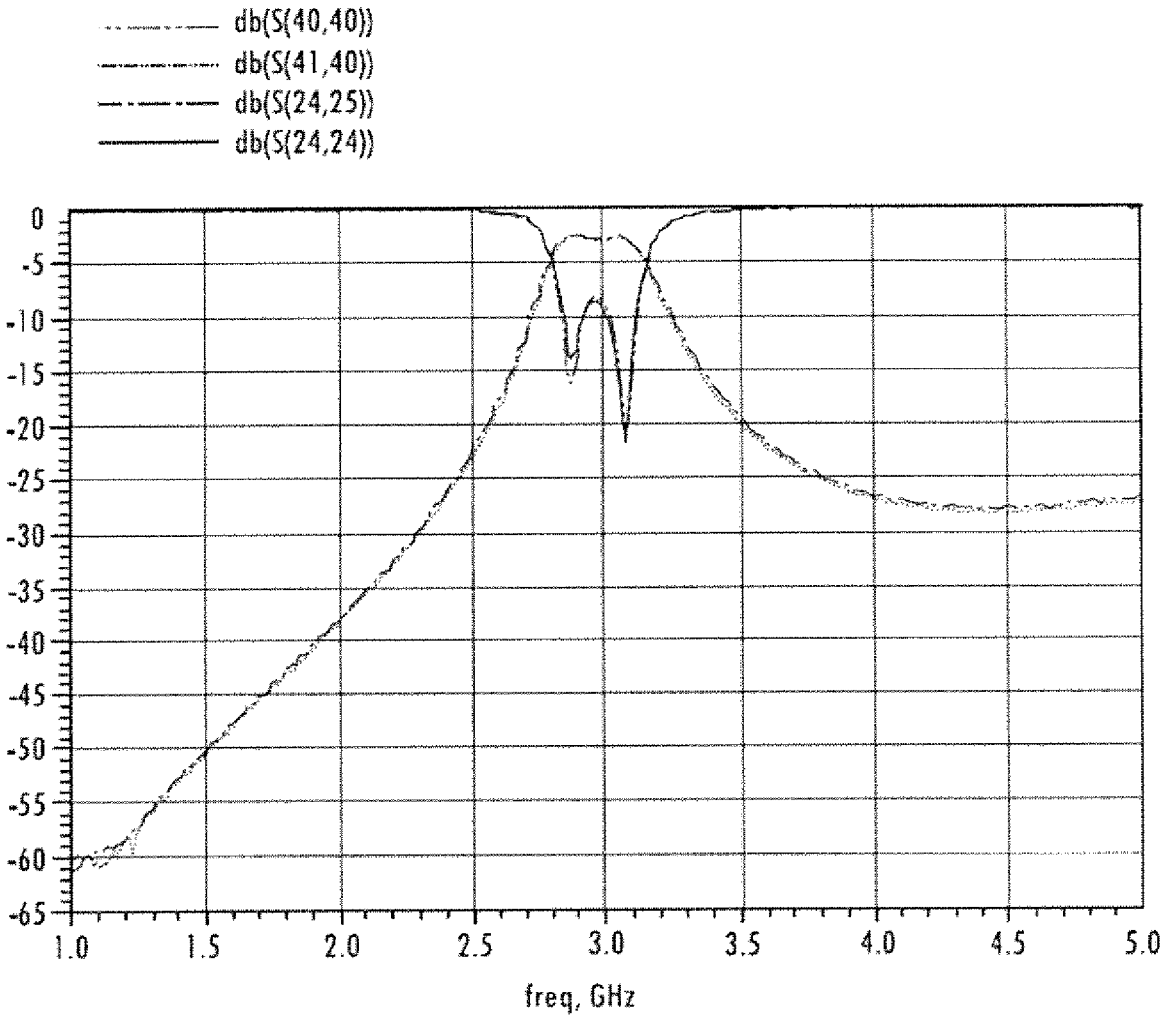
Figure 10:
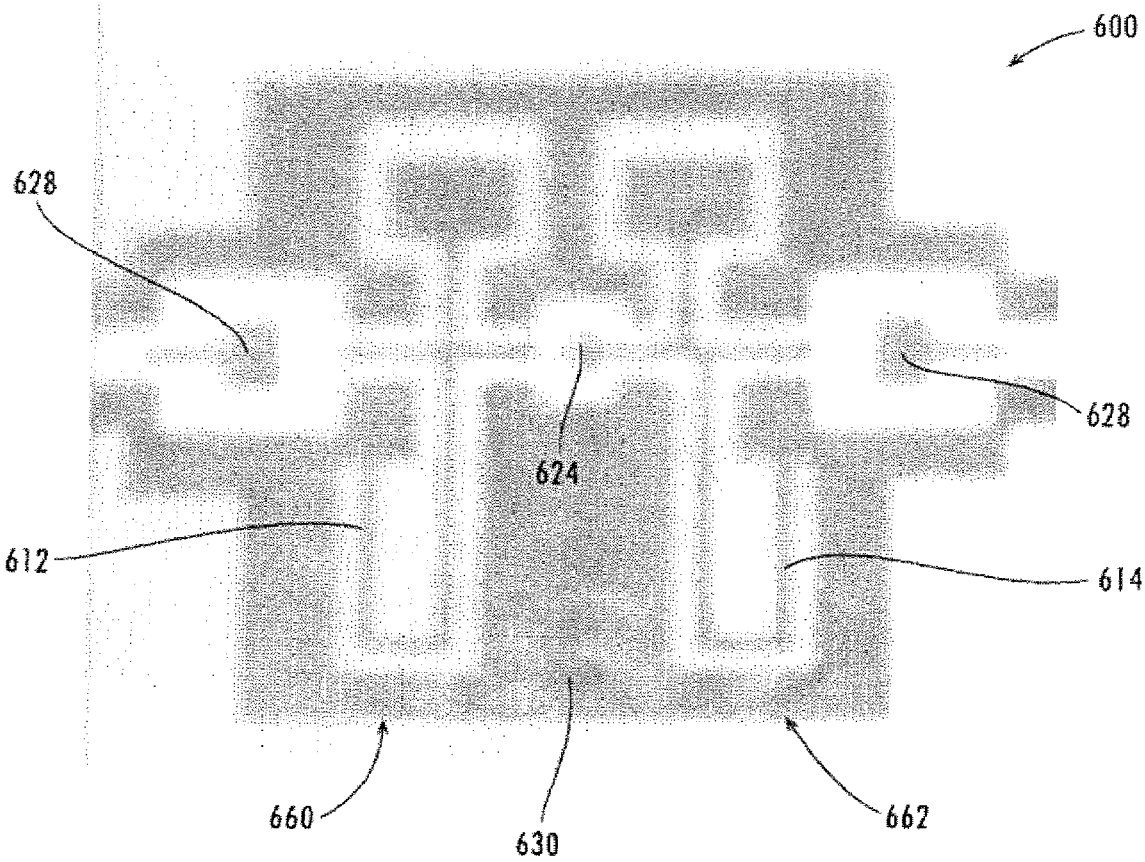

FIG. 8 is an X-ray from a side perspective view of the organic bandpass filter of FIG. 7, FIG. 9 is a graphical representation of a model to hardware correlation for the organic bandpass filter of FIG. 7, FIG. 10 is a picture from a top plan view of a BGA style organic filter, in accordance with an embodiment of the present invention.

Figure 11:
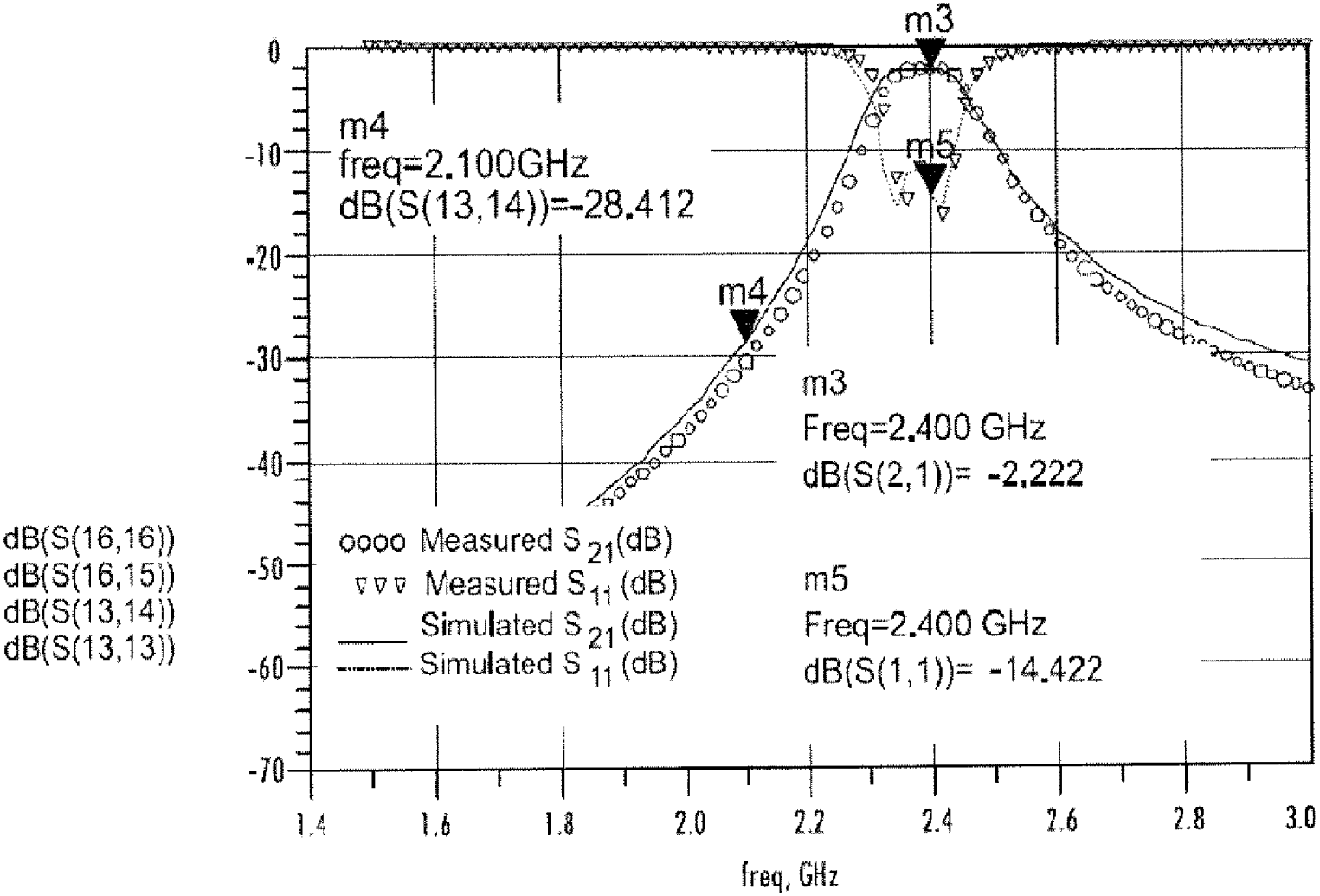

FIG. 11 is a graphical representation of measured and modeled data for the BGA style organic filter in FIG. 10.

Figure 12:
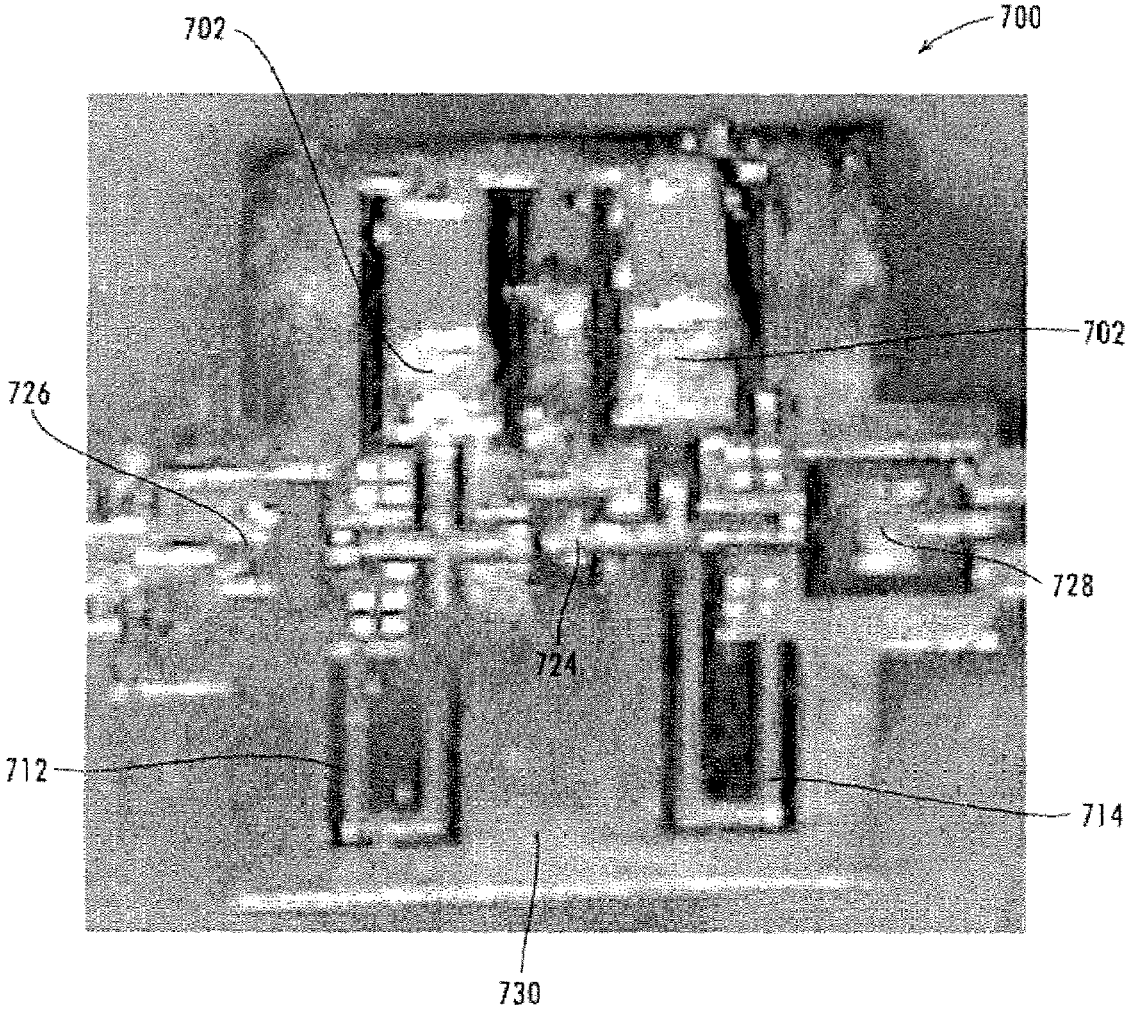

FIG. 12 is a picture from a top plan view of an organic dielectric filter that includes SMD capacitors in accordance with an embodiment of the present invention.

Figure 13:
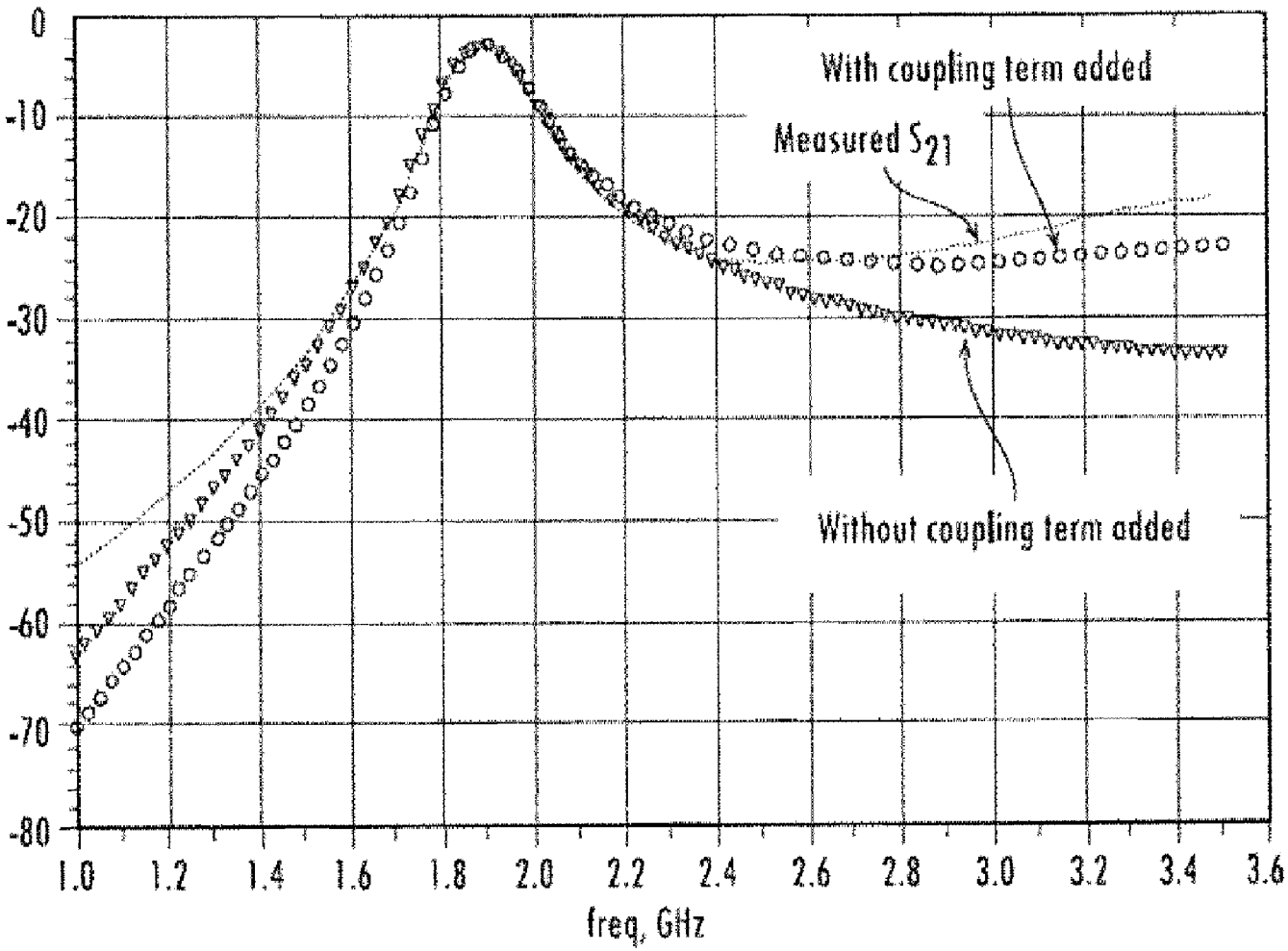

FIG. 13 is a graphical representation of a model to hardware correlation for the organic dielectric filter in FIG. 12.

FIGS. 14A-14D illustrate exemplary views of a single stitched metal layer building block for a high-performing inductor, according to an exemplary embodiment of the present invention.

FIGS. 15A-D illustrate exemplary views of two stitched metal layer building blocks for a high-performing inductor, according to an exemplary embodiment of the present invention.

FIGS. 16A-D illustrate exemplary views of three stitched metal layer building blocks for a high-performing inductor, according to an exemplary embodiment of the present invention.

Figure 17:
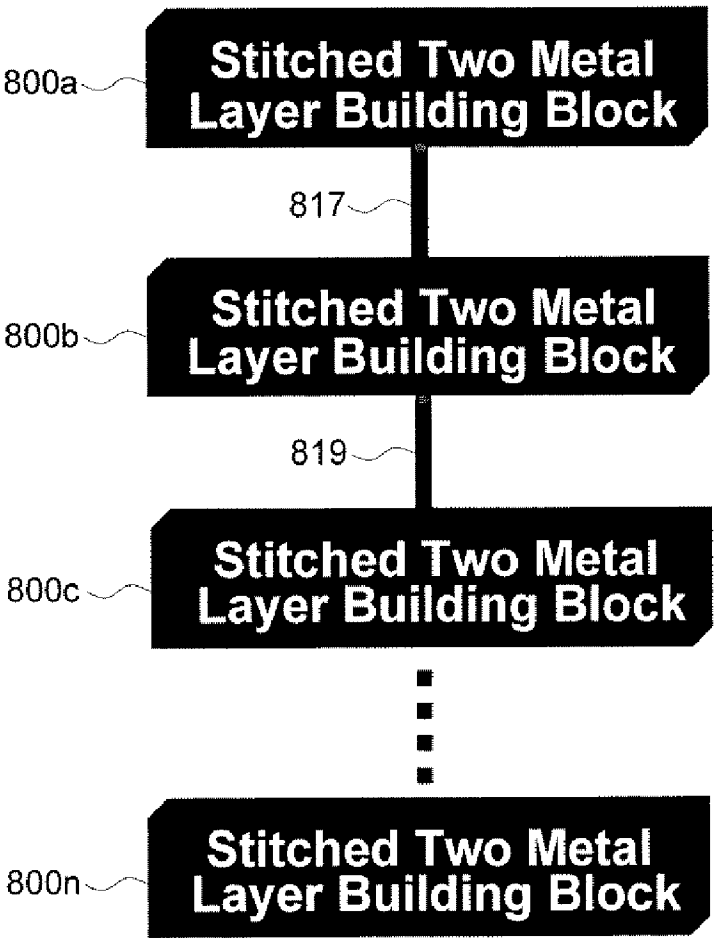

FIG. 17 illustrates a functional block diagram for connecting a number of staticed metal layer building blocks to form a high-performing inductor, according to an exemplary embodiment of the present invention.

Figure 18A:
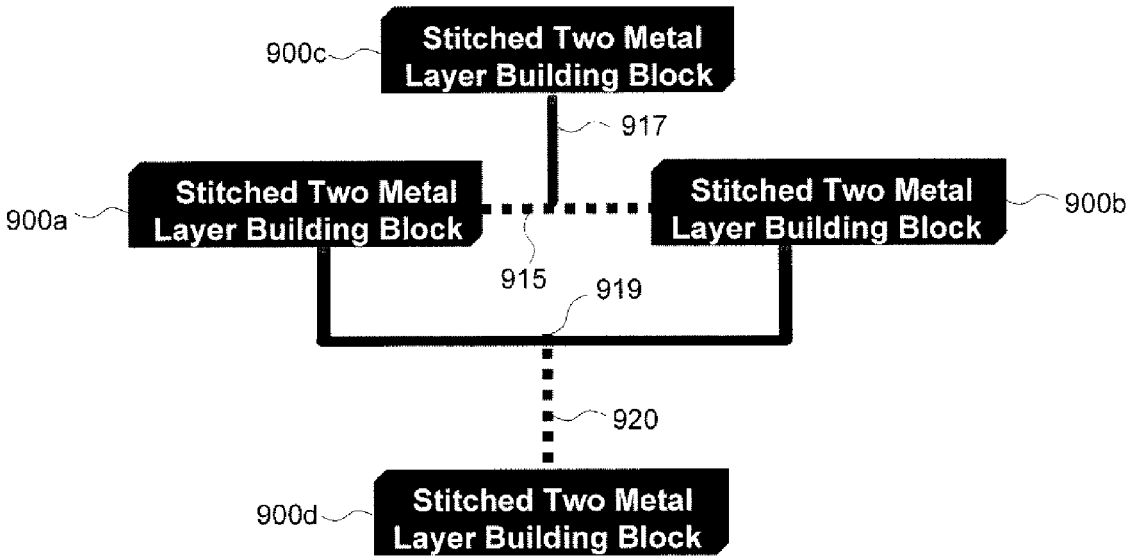

FIG. 18A illustrates a functional block diagram for connecting a number of stitched metal layer building blocks both horizontally and vertically to form a high-performing inductor, according to an exemplary embodiment of the present invention.

Figure 18B:
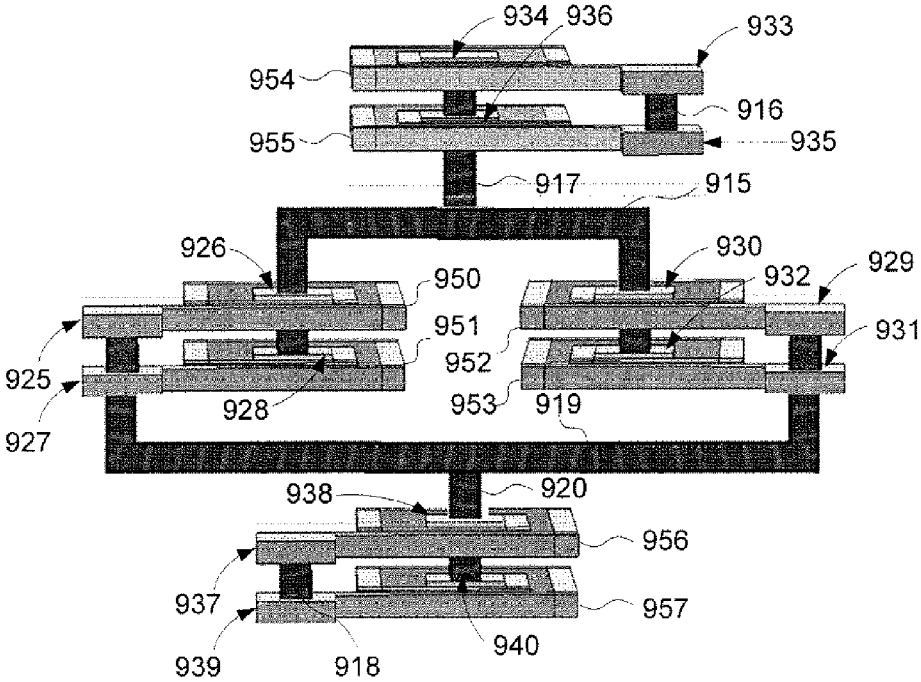

FIG. 18B illustrates an exemplary 3-D view of the high-performing inductor of FIG. 18A, according to an exemplary embodiment of the present invention.

DETAILED DESCRIPTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

I. Filter Design

The operation of a filter in accordance with an embodiment of the present invention is explained below with reference to the bandpass filter 10 of FIG. 1A. However, it will be appreciated by those of ordinary skill in the art that the teachings of the present invention readily apply to other integrated passive devices, including high-performing multi-layer inductors as described below and other devices incorporating such multi-layer inductors. Accordingly, the scope of the present invention is not limited to bandpass filters, but is inclusive of other devices such as but not limited to diplexer, duplexer, multiplexer, baluns, power combiner, band-stop/band elimination filter, power divider, low-pass filter, high-pass filter, voltage controlled oscillators (VCOs), and low noise amplifiers (LNAs).

With reference to the figures, FIG. 1A is an equivalent circuit diagram of a dielectric bandpass filter 10 in accordance with an embodiment of the present invention. In FIG. 1A, inductors 12, 14 cooperate with their corresponding capacitor 16, 18, respectively, to form resonators 20, 22, respectively. The inductors 12, 14 correspond to the stripline or CPW/strip-line or CPW-microstrip inductors discussed below with reference to FIGS. 2-4. The capacitors 16 and 18, respectively, correspond to the capacitors formed on the same layer as inductors 12 and 14 or by using discrete capacitors. The capacitor 24 corresponds to the capacitor formed for the purposes of inter-resonator coupling. In FIG. 1A, capacitors 26 and 28, respectively, provide matching to the desired impedances at the input and output. In addition, M is the magnetic coupling between the inductors 12 and 14. The inductances of inductors 12 and 14 could also represent equivalent inductance components of the resonators, and capacitances of capacitors 16 and 18 could represent capacitance components of the resonators. While the circuit topology shown in FIG. 1A depicts one embodiment of a two pole filter, and an additional pole can be attained by the mutual inductance between inductors 12, 14 and the capacitor 24. In addition, resonators may be added with the required coupling elements by adding more inductors and capacitors in various configurations to achieve transfer characteristics that emulate such responses as first order, second order to nth order butterworth, chebychev, elliptic, blinkoff, symmetric, asymmetric, notch added filters using topologies such as nodal capacitor coupled, nodal-inductor coupled, shunt-input geometry, input geometry or mesh capacitor coupled.

The stopband characteristics of a filter is a prime factor in determining the isolation between the transmitting and receiving paths in duplexer designs. It is well known that the stopband rejection may be enhanced, either by increasing the number of resonators as mentioned earlier, or by adding transmission zeros.

FIG. 1B is an alternative equivalent circuit diagram 10 of a dielectric filter using transmission lines or inductor resonator elements, wherein the inductors 112 resonate at a desired center frequency. The physical parameters of the circuit 110, such as the number of turns, length of conductor, outer and inner diameter, can be altered to resonate the inductor 112 at the desired frequency. This reduces the number of components required to achieve a filtering function by removing the need for capacitors of the resonators. However, a disadvantage is the increase in length of the metallization to increase the capacitance, though the increased inductance could increase loss in the circuit. If the inductor element becomes too large or too lossy, then it may be desirable to use an alternative circuit design, such as that illustrated in FIG. 1A. It should be noted that in the circuits of FIG. 1A and FIG. 1B, the coupling between the components can be achieved by magnetic coupling, electric coupling or a combination thereof.

Illustrative physical layouts of dielectric filters in accordance with the equivalent circuit diagram of FIG. 1A are depicted in FIGS. 2-4. The dielectric filters of FIGS. 2-4 have a two-pole structure and an additional pole attained by the mutual inductance and the capacitor 24 according to the equivalent circuit diagram shown in FIG. 1A.

With general reference to FIGS. 2A-2C, illustrated is a surface mounted device (SMD) embodiment of the filter illustrated by the circuit of FIG. 1A in accordance with an embodiment of the present invention. Specifically, the organic bandpass filter 200 comprises inductors 212 and 214, which are meandering inductors formed close to each other on an organic dielectric layer 236 (which can be a thin laminate such as LCP or PPE, but is not limited to these) and is preferably configured as either a shorted hybrid CPW-stripline (where lines that form meandering inductors 212 and 214 are connected to a coplanar ground, that is, in-built shielding 230), or a stripline in the presence of coplanar in-built shielding 230 and additional grounds 248 and 250 that are connected to the plated through holes 232 and/or external shield electrodes 234.

Since these inductors are very close to each other, the magnetic coupling between these filters, represented by M in FIG. 1A, can increase the pass bandwidth of the filter, thereby decreasing its performance. However, an inter-resonator parallel plate coupling capacitor 224, (with or without the coplanar in-built shielding 230) formed using two disconnected metal plates (one plate formed using patterning conductive layer 238 and the other plate formed using patterned conductive layer 240) and shown as capacitor plates 224*a*, 224*b* is provided. The capacitor plates 224*a*, 224*b* sandwich the first organic dielectric layer 236 in such a manner that the each plate of the inter-resonator coupling capacitor electrode is connected to separate resonators which helps compensate the effect of the magnetic coupling and helps make very compact filters. The center capacitance can be as small as femptoFarads or as large as picoFarads for achieving the specified bandwidths. The smaller capacitance helps reduce the bandwidth. Additionally, capacitor 224 in parallel with the mutual inductance equivalent gives a pole in the lower band or upper band.

The bottom plate formed by the conductive layer 240 connects to inductor 212 using one or more microvias in the organic dielectric layer 236, such as the vias 244 with pads 246 for landing and capturing the via. First and second shield electrodes 248, 250 formed respectively on the organic core layers 252, 254, wherein the core layer 252 and 254 are disposed so as to sandwich the organic dielectric layer 236 there between. A first resonator 260 formed by inductor 212 and capacitor 216 and a second resonator 262 formed by inductor 214 and capacitor 218 are electrically coupled to each other through the parallel plate capacitor 224, whereby an inter-resonator coupling is effected in combination with said magnetic coupling and electric coupling.

In a dielectric filter according to an embodiment of the present invention, where the inductors do not provide the needed capacitance in the desired length, the inductors 212, 214 can be connected in similar fashion as the capacitor 224 to separate grounded/shunted parallel plates 216*a* and 218*a*, respectively, of capacitors 216 and 218, respectively, using the same first organic dielectric layer 236 as the sandwiched dielectric, which then together form the resonator pairs 260, 262.

The equivalent inductance L obtained with one of the meander inductors, 212, 214, and the equivalent capacitance C due to one of the capacitors 216, 218, resonates approximately at frequency Fo, the center frequency of the filter, as defined by Equation (1) below:

$$\text{whereby } Fo \sim \sqrt{1/(LC)} \quad (1)$$

The capacitor plates 216*a* and 218*a* have a corresponding ground plate 217 on the opposite surface of the organic dielectric layer 236. Having a common plate does cause coupling between the capacitors which has to be accounted for during the design by including it as the mutual inductance between the parasitic inductance of each capacitor 216, 218. This coupling can be used to achieve further poles; however if the coupling causes problems in the passband during the synthesis stage it could be reduced by either dividing plate 217 into separate plates or by adding several vias on pads 274 that connect plate 217 to in-built shielding 230 on the side of the inductors 212 and 214, thereby helping excess currents to sink and thereby reducing coupling between components.

In addition, parallel plate/interdigital capacitors 226 and 228, can be used on either side of the first and last resonator elements 260, 262 at the input and output terminals of the device for impedance matching purposes. Alternatively, inductors or transmission lines or a combination of capacitor(s), inductor(s) and transmission line(s) can be utilized, as desired. If capacitors 226, 228 are used for matching purposes, it follows the center capacitance is that of capacitor 224 in terms of the nominal capacitances required, that is, the capacitance from capacitor 226 and capacitor 228 are proportional to capacitor 224.

A dielectric filter according to the embodiment of the present invention illustrated in FIGS. 2A-2C can comprise at least two external shield electrodes 234 respectively formed on different side surfaces of the laminated structure, which comprises at least the organic dielectric layer 252, 236, 254, and that are connected to the shield electrodes 248 and 250. This may or may not be desired for shielding purposes in a CPW topology, wherein the use of plated through holes 232 on the four corners is sufficient. Utilizing the plated through holes 232 may save additional room required for the external shield electrodes 234 and also may save the processing cost involved. However, in stripline and microstrip filter topologies, plated through holes 232 and external shield electrodes 234 together provide the connection for the shorted inductors/resonators and capacitors at any point along the respective sides. Alternatively, the CPW topology with coplanar in-built shielding 230 on the same plane of the first dielectric layer provides the shielding internally, and provides for the ground connectivity to the resonators/inductors and capacitors. However, in general, in more noisy environments it may be preferred to also have the external ground electrodes.

The dielectric filter 200 also comprises an external input terminal electrode 264 and an external output terminal electrode 266 which are formed on one side surface of a laminated body comprising at least dielectric sheets 252, 236, 254, and an external ground electrode, (such as shield electrodes 248, 250, through holes 232 or side shield electrodes 234) formed between said external input and output terminal electrodes 264, 266 on one side surface.

The shield electrodes 248 and 250 formed on the dielectric core layers 252 and 254, respectively, are preferably of the shape and patterned to leave room for the landing terminals of input and output terminal electrodes 264 and 266. For purposes of illustrating the an exemplary embodiment of the present invention, the shield electrodes 248, 250 are shown in FIGS. 2B and 2C, but not 2A.

The first organic dielectric layer 236 can comprise single side copper LCP laminate or the like, such as PPE, N6000, epoxy based N4000-13, or any other suitable low loss dielectric.

The protective layers 270, 272 are formed on shield electrodes 248, 250 opposite dielectric core layers 252, 254, respectively, to protect the structure from environmental affects such as oxidation and also to create a pattern for solder to flow on to the input output terminals 264 and 266 and ground pads formed by plated through holes 232. The protective layers 270, 272 may comprise a solder mask, or in more demanding applications, with higher tolerances, other materials such as prepreg or LCP may be desired. For purposes of illustrating an exemplary embodiment of the present invention, the protective layers 270, 272 are shown in FIGS. 2A and 2B, but not 2C.

In the dielectric filter according to an embodiment of the present invention, as illustrated in FIGS. 2A-2C, an initial step to making a connection between devices using vias 244 is done by drilling through holes (as small in diameters as the thickness of the dielectric used) through the LCP layer (or any other appropriate organic dielectric) and copper layer. Then both sides of LCP copper laminate are metallized, such as by electroless or vacuum deposited copper. Copper is then electroplated on both sides of laminate to form the metallized patterns 238, 240 on the organic dielectric layer 236. The copper is then printed and etched to define the key filter components.

In the dielectric filter according to the embodiment illustrated in FIGS. 2A-2C, the dielectric core layers 252, 254 can be laminate LCP or appropriate dielectric with generally larger thickness than the first substrate and aluminum, copper, Molybenum metal (for high power applications) on both sides of filter to a given thickness to encapsulate components. All metals are preferably electroplate and etched and patterned on top and bottom of the device to leave space for signal input and output.

In a dielectric filter according to the embodiment illustrated in FIGS. 2A-2C, the side wall ground shield electrodes 232, 234 can be fabricated, if desired, by single or multiple connected drilled and plated through holes or using a saw cutting device and then connected via electroless or sputter seeded copper in through hole. The copper can be electroplated in the through hole and on the surface. The copper can then be printed and etched to form SMD connection. The process flow for a two layer plus the packaging of the SMD device is explained in greater detail in connection with FIG. 5.

With reference to FIGS. 3A-3C, illustrated, is a BGA/CSP embodiment of an organic bandpass filter 300 in accordance with an embodiment of the present invention. Essentially, all of the internal structure in the filter depicted in FIGS. 2A-2C and FIGS. 3A-3C are similar except the packaging is different, and thereby, the means by which you package it. For example, in FIGS. 3A-3C the thin laminate (e.g., the organic dielectric layer 336) is not packaged between two thick cores, but is packaged with one core layer 354 on one side and a first protective layer 370 on the opposite side substrate 336. The opposite side of the thicker core 354 is metallized to form a shield electrode 350, and a second protective layer 372 is disposed over the shield electrode 350. The protective layers may comprise a solder mask, or in more demanding applications, with higher tolerances, other materials such as prepreg or LCP may be desired.

This packaging of filter 300 renders a microstrip or CPW/microstrip filter device with only shield electrode 350. Instead of using through holes to connect the device input/output and ground terminals, solder balls 380 are utilized.

Side wall ground shield electrodes 334 are used to connect the in-built shielding electrodes 330 and shield electrode 350 and, if desired, to solder balls 380.

Alternatively, this could be done by plated through holes, if provided. As discussed above, having both plated through holes 332 and side wall shield electrodes 334 is not typically necessary, and generally they can be utilized in the alternative of one another. For purposes of illustrating an exemplary embodiment of the present invention, side wall grounded shield electrodes 334 are shown in FIG. 3A-3C. The solder balls 382 connect the input and output terminals to the band-pass filter. The solder balls and the packaging is constructed using the methodology provided below in connection with FIG. 6. The protective layer 370 (also known as a passivation layer mask, solder mask, bondply layer or low temperature thermoset, thermopolymer material compound to inner laminate) may be utilized to provide openings for the solder balls, as well known in the art.

With reference to FIGS. 4A-4B, illustrated is an embodiment of a filter device 400 in accordance with an embodiment of the present invention, which utilizes discrete capacitors 402 and external shielded formed by a metallic case or cap 404. Essentially, all internal structure in FIGS. 2A-2C and FIG. 3A-3C are similar except the packaging is different in the embodiment of FIGS. 4A-4B, and thereby the means by which you package it. For example, in FIGS. 4A-4C, an organic dielectric layer 436 (e.g., a thin laminate substrate) is not packaged between two thick cores, but only one core layer 454 on one side, wherein a shielding electrode 450 is metallized on the opposite side of the core layer 454. On the other side of the organic dielectric layer 436 is a metallic cap 404 with the appropriate height which is used to provide a second ground reference. The organic dielectric layer 436 is metallized on opposing surfaces by patterned conductive layers 438 and 440, which are electrically connected by at least microvias in layer 436, as discussed with regard to the embodiments of FIGS. 2 and 3. Instead of using a thicker core on both sides of the substrate 436, this embodiment uses a core layer on one side and air as a dielectric on the other. This renders itself into a stripline or CPW/stripline device. Through holes are used to connect only the core metal to the internal metallic structure whereas the metallic cap 404 is connected using solder connections to the relative terminals. The metallic cap 404 can have openings where needed for the input and output terminals. It is important to note that the embodiment is not restricted to using discrete capacitors. The capacitors shown in FIGS. 4A-4B can also be embedded in the substrate, if needed, as discussed previously.

The following are examples of various embodiments of the present invention, wherein each illustrative embodiments discloses several aspects of the invention.

II. Illustrative Methods for Fabricating Stand Alone Filters

An illustrative process for fabricating an LCP based IPD, such as the filter illustrated in FIGS. 2A-2C, configured as a surface mount device (SMD) in accordance with an embodiment of the present invention is now described with reference generally to FIG. 5. Initially, a starting material is selected, which is preferably a reinforced or non-reinforced LCP laminate that can be unclad, or cladded with copper foil on one or both sides of the LCP, as illustrated in Step 1. Alternate materials include other low loss organic laminates like PPE, PTFE composites, hydrocarbon ceramic composites, BT resin composites (e.g., Speedboard C), and thermosets (e.g., Hitachi MCL-LX-67F). Next, through vias are drilled through the LCP or other laminate and the layers of copper, as illustrated in Step 2. These microvias can be drilled with mechanical drilling, laser drilling or other suitable methods known to those skilled in the art.

Steps 3 and 4 involve the metallization of the through vias and laminate. In additive, semi-additive, or subtractive processes starting with unclad or copper clad LCP or other laminates, both sides of the LCP or other laminate and the vias are seeded using electroless plated, vacuum deposited copper or another deposition methods to form a continuous copper film. To achieve the target metal thickness for the device, electrolytic plating is done to build the copper on both sides of the laminate and in the vias in a single step. The circuit definition for the filter component can be done using subtractive, semi-additive or fully additive processes with panel or pattern electroplating of the copper followed by print and etch steps to define the filter circuitry, as illustrated in Step 5.

The fabricated device circuits are then packaged using vacuum or non-vacuum lamination of LCP or alternate laminate materials as detailed above in connection with Step 1, and/or Al, Cu, Mo metal (for high power applications) on both sides of the filter to provide sufficient thickness to encapsulate components, as illustrated in Step 6. The internal and external metal layers are connected, as needed, using plated through holes that can be drilled mechanically or with laser, photo, or plasma processes to provide signal and ground connections and SMD terminals, as illustrated in Step 7. The two edges of the device without the through hole can also slotted using mechanical drill/rout/mill, laser cutting, or sawing processes to provide for additional shielding of the device during subsequent metallization. The drilled through holes and shielding slots are seeded with electroless plated or sputter/vacuum deposited copper to provide a bus layer in substantially the same manner as described above in connection with Step 3, as illustrated in Step 8.

With reference to Steps 9, 10, and 11, the final metal thickness for the outer layers is built up by electroplated copper in the through holes, shielding slots, and on the top and bottom surfaces. Subtractive, semi-additive, or additive processes may be used to define the outerlayer ground circuits and SMD terminals for connection, with print and etch processing of the copper, as described above in connection with Steps 4 and 5. The device is then finished with the addition of terminal metals appropriate for SMD assembly and soldering processes. These finishing metals on the device terminals are common plated metals or alloys like electroless Ni—Au, immersion tin, immersion silver, electroplated Ni—Au, solder (HASL), or organic finishes (OSPs) and the choice depends on the intended application.

The fully fabricated wafer is then singulated into individual filter components. The singulation can be done using high speed dicing saws or alternate methods such as punching or routing/milling. An advantage of this fabrication process is the ability to fully electrical test the components either before or after singulation.

Another illustrative process for fabricating an LCP based IPD, such as the filter illustrated in FIGS. 3A-3C, configured as a ball grid array (BGA) or chip scale package (CSP) in accordance with an embodiment of the present invention is now described with reference generally to FIG. 6. Initially, a starting material is selected, preferably a reinforced or non-reinforced LCP laminate that can be unclad, or cladded with copper foil on one or both sides of the LCP, as illustrated in Step 1. Alternate materials include other low loss organic laminates like PPE, PTFE composites, hydrocarbon ceramic composites, BT resin composites (e.g., Speedboard C), and thermosets (e.g., Hitachi MCL-LX-67F). Next, through vias are drilled through the LCP or other laminate and the layers of copper, as illustrated in Step 2. The microvias can be drilled with mechanical drilling, laser drilling or other suitable methods known to those skilled in the art.

Steps 3 and 4 involve the metallization of the through vias and laminate. In additive, semi-additive, or subtractive processes starting with unclad or copper clad LCP or other laminates, both sides of the LCP or other laminate and the vias are seeded using electroless plated, vacuum deposited copper or other common deposition methods to form a continuous copper film. To achieve the target metal thickness for the device, electrolytic plating is done to build the copper on both sides of the laminate and in the vias in a single step. The circuit definition for the filter component can be done using subtractive, semi-additive or fully additive processes with panel or pattern electroplating of copper followed by print and etch steps to define the filter circuitry, as illustrated in Step 5.

The fabricated device circuits are then packaged using vacuum or non-vacuum lamination of LCP or alternate laminate materials detailed above in connection with Step 1, and/or Al. Cu, Mo metal (for high power applications) on both sides of the filter to a given thickness to encapsulate components, as illustrated in Step 6.

On the other side of the filter component, a cover coat material, liquid photo imagable (LPI), or dry film solder mask is deposited using standard processes such as spin coating, curtain or roller coating, dry film lamination, spray coating and others, as illustrated in Steps 7, 8 and 9. This layer acts as a barrier to solder flow between terminals during subsequent reflow and component assembly. The component terminals are defined by opening windows in the cover coat/soldermask material to open the BGA pads for board level interconnection. This is done with processes such as photolithography or laser ablation. The device is then finished with the addition of terminal metals appropriate for BGA assembly and soldering processes. These finishing metals on the device terminals are common plated metals or alloys like electroless Ni—Au, immersion tin, immersion silver, electroplated Ni—Au, solder (HASL), or organic finishes (OSPs) and the choice depends on the intended application and compatibility with the solder or other alloy used for device-to-module/PWB interconnection.

With general reference to Steps 10, 11, 12, the interconnects are formed in the windows in the manner defined in Step 8 using Pb/Sn solder, or other lead free solders and metal alloys. Processes such as screen or stencil printing of solder paste and reflow, or plating processes can be used to form the bumps for interconnection. The BGA/CSP format of the filter components enables the testing of the components on the large area board prior to singulation. The testing can be done, for example, with probing techniques or using test sockets or fixtures.

The fully fabricated wafer is then singulated into individual filter components. The singulation can be done using high speed dicing saws or alternate methods such as punching or routing/milling. An advantage of this fabrication process is the ability to fully electrical test the components either before or after singulation.

III. Exemplary Bandpass Filters

EXAMPLE I

An X-ray photograph of an organic bandpass filter 500 in accordance with an embodiment of the present invention is provided in FIGS. 7 and 8. The filter 500 comprises shorted hybrid CPW-stripline meander transmission line inductors 512, 514 formed close to each other on a first organic dielectric layer, which is a 50 μm thick layer of LCP, wherein the inductors 512, 514 are directly magnetically coupled to each other. Each inductor is connected to separate parallel plate capacitors 516, 518 by sandwiching the same dielectric sheet. An inter-resonator parallel plate coupling capacitor 524, is formed using two disconnected metal plates that sandwich the same organic dielectric sheet in such a manner that the each plate of the inter-resonator coupling capacitor electrode connects to separate inductors. In addition, a second organic dielectric layer and a third organic dielectric layer sandwich the first organic dielectric layer, and comprise a high frequency hydrocarbon material with a thickness of 30-40 mils, which are disposed so as to sandwich said first dielectric sheets there between.

The bandpass filter 500 further comprises an additional dielectric layer, in this case solder mask, provided on an outermost one of the shield electrodes to protect the outermost shield electrodes. The inductors 512, 514 did not provide the needed capacitance in the desired length, and therefore each are connected to a separate grounded/shunted parallel plate using the same first organic layer as the sandwiched dielectric, which then together form the resonator pairs 560, 562, as illustrated. In the illustrated device, parallel plate capacitors 526, 528 are utilized on either side of the first and last resonator elements at the input and output terminals of the device for impedance matching purposes. If greater density is desired multiple thin layers such as the first dielectric layer can be used to form multi (>2) plate capacitors.

The bandpass filter 500 further comprise at two external ground shield electrodes 534 respectively formed on different side surfaces of a laminated body comprising said first through three or more dielectric layers and connected to said shield electrodes. Additionally these provide the connection for the shorted inductors/resonators and capacitors. Moreover, the presence of these external electrodes makes it a CPW/stripline topology, where the reference is on the same first dielectric layer provides the shielding internally, and also provides for the ground connectivity to the resonators/inductors and capacitors.

The bandpass filter further comprises an external input terminal electrode 564 and an external output terminal electrode 566 which are formed on one side surface of a laminated body comprising said first through three or more dielectric sheets. External side wall shield electrodes 534 (FIG. 7) are provided between said external input and output terminal electrodes on the side surfaces of the laminated body and external ground shield electrodes 548 are provided on opposing top and bottom surfaces of the laminated body and are electrically connected to the side wall shield electrodes 534.

The patterning of the external ground shields electrodes 548 on the top and bottom surfaces is required for leaving space for the signal input output as shown in FIGS. 7 and 8.

In the organic bandpass filter 500, the first step to making connection between devices is done by drilling through holes as small as 2 mils with pads as big as three times the size of the via through LCP and copper. Both sides of LCP copper laminate are then metalized via electroless. The copper on both sides of laminate is then electroplated, and the copper layer is printed and etched to define filter component.

The second and third organic dielectric layers are Rogers 4350 from Rogers Corporation with a generally larger thickness than the first organic dielectric layer, such as approximately 35 mils, with copper metal (for high power applications) on both sides of filter to a given thickness to encapsulate components. All metals are electroplate and etched and patterned on top and bottom of the device to leave space for signal input and output.

The side wall grounded shield electrodes 534 can be obtained by single or multiple connected drilled plated through holes and then connected via electroless or sputter seeded copper in through hole. Electroplate copper in through hole and on surface. Print and etch copper to form SMD connection. The copper electrodes may be electroless NiAu plate to prevent excess oxidation.

FIG. 9 shows model to hardware correlation for the organic bandpass filter 500 in FIGS. 7 and 8. The filter was measured using an HP 8720ES Vector Network Analyzer after performing a SOLT calibration. The measured data for the fabricated filter and simulated data is shown. As evident from FIG. 9, there is excellent correlation between measured data and simulated data. The organic bandpass filter 500 was fabricated using LCP for the first organic dielectric layer, and shows an insertion loss of only 1.88 dB at 3 GHz and a 1 dB bandwidth of 200 MHz. Such a filter would be suitable for IF frequency use in fixed wireless type receivers where the carriers frequency of the incoming signal is approximately 14 GHz and has to be down-converted to several lower frequency signals.

The organic bandpass filter 500 utilizes a CPW/stripline topology with only two metallization levels and all embedded passives in an organic substrate, which resulted in better performance than non-standardized multilayer (>5) ceramic processes, as seen in FIG. 9.

It is worth noting that while the Q of the capacitors for filter 500 was measured as high as 200 at 3 GHz using LCP, the Q for the inductor was kept at the required level of approximately 100 at 3 GHz. This was done to understand the advantages of using a material such as LCP without optimizing the design for the inductors. However, Qs exceeding 200 are also attainable for inductors on organic substrates. A resimulation for the filter circuit shown, but with Qs of 200 for the inductors, showed an insertion loss of 1.15 dB when simulated. A filter with a loss of 1.15 dB at the frequency and bandwidth can be alternatively achieved only by using the bulkier and costlier ceramic cavity and monoblock filters.

EXAMPLE II

Another organic bandpass filter 600 in accordance with an embodiment of the present invention is shown in the picture of FIG. 10. The filter 600 comprises shorted hybrid CPW-microstrip, meander inductors 612, 614 formed close to each other on a first organic dielectric layer, which is a layer of LCP, directly magnetically coupled to each other. The term "shorted" refers to one end of each inductor connected to the large metallic area, which in this case serves as the in-built shield 630 (also referred to as a coplanar ground ring). In addition, the filter 600 includes an inter-resonator parallel plate coupling capacitor electrode 624 with in-built shield 630 formed using two disconnected metal plates that sandwich the first organic dielectric layer in such a manner that the each plate of the inter-resonator coupling capacitor electrode connects to separate resonators. Yet further, the filter 600 includes a first shield electrode formed respectively on a second organic dielectric layer, which in this case is Rogers 4350 from Rogers Corporation, and which is disposed over the circuitry described above, so as to sandwich and substantially completely shield one surface of the filter.

The filter may further comprise a third organic dielectric sheet, if needed, provided on the outside of the shield electrode to protect the outermost shield electrode. In this filter, the inductors 612, 614 did not provide the needed capacitance in the desired length, and therefore each is connected to a separate grounded/shunted parallel plate (two plate) using the same first organic layer as the sandwiched dielectric, which then together form the resonator pairs. In addition, parallel plate/interdigital capacitors 626, 628 are utilized on either side of the first and last resonator elements at the input and output terminals of the device for impedance matching purposes. If greater density is desired, then multiple thin layers such as the first dielectric layer can be used to form multi (>2) plate capacitors. In addition, another dielectric layer such as lower temperature melt LCP compare to the higher melt temp LCP used as the first dielectric is laminated on the other side of the first substrate (not the same side as the second substrate), and then solder bump openings are made where ground and input output connections are required to connect the device to corresponding terminals on the board.

The CPW topology, where the reference is on the same first dielectric layer provides the shielding internally, provides for the ground connectivity to the resonators/inductors and capacitors. However in more noisy environments the external electrodes, such as those in Example I, could be added for added shielding.

In the second bandpass filter, the openings in the third substrate allow for the ground connection connected to the CPW ground and two other openings not connected to each other or the ground serving for input and output terminals.

The first step to making connection between devices is by drilling through holes (as small in diameters as the thickness of the dielectric used) through the first organic dielectric layer of LCP and copper. Then both sides of LCP copper laminate are metalized via electroless copper. Copper is then electroplated on both sides of laminate. The copper is then printed and etched to define filter component.

The second organic dielectric layer can be laminate LCP or another appropriate dielectric with generally larger thickness than the first organic dielectric layer with copper metal (for high power applications) plated on top of the filter to a given thickness of approximately 20-30 μm to encapsulate components. The third organic dielectric layer is laminate LCP or another appropriate dielectric with generally larger or smaller thickness than the first organic dielectric layer with copper plated in the openings to a given thickness to provide for solder landing pads. The openings in the third substrate are filled with screen solder paste and reflowed to form bumps.

FIG. 11 shows model to hardware correlation for the organic bandpass filter 600 in FIG. 10. In summary, the filter utilizes a CPW topology with only two metallization levels and all embedded passives in an organic substrate, which resulted in better performance than of non-standardized multilayer (>5) ceramic processes. As the adoption of lower loss materials, such as LCP, becomes more common, this design shows the feasibility of integrating very low loss filters for applications such as Bluetooth/WLAN in compact boards and packages.

The measured data for the filter 600 and simulated data is shown in FIG. 11. As seen there is excellent correlation between measured data and simulated data. The filter 600 has an insertion loss of only 2.22 dB.

It is worth noting that while the Q of capacitors may be as high as 300 using LCP, the Q for the inductor was kept at the required level of approximately 130. The insertion loss was 0.6 dB lower than the MLC filters with similar footprint. A resimulation for the filter circuit shown, but with Qs of 200 for the inductors, showed an insertion loss of 1.65 dB when simulated. A filter with a loss of 1.65 dB at the frequency and bandwidth desired of the Bluetooth/WLAN filter can be alternatively achieved only by using the bulkier and costlier ceramic cavity and monoblock filters.

EXAMPLE III

Yet another organic bandpass filter 700 in accordance with an embodiment of the present invention is shown in the picture of FIG. 12. The organic bandpass filter 700 comprises shorted hybrid CPW-microstrip meander inductors formed close to each other on a first organic dielectric substrate, such as epoxy based Vialux by E.I. du Pont de Nemours and Company, directly magnetically coupled to each other. In addition, the third bandpass filter comprises an inter-resonator parallel plate coupling capacitor electrode 724, with ground ring, formed using two disconnected metal plates that sandwich the same organic dielectric sheet in such a manner that the each plate of the inter-resonator coupling capacitor electrode connects to separate resonators.

The transmission line inductors 712, 714 did not provide the needed capacitance in the desired length. Since the dielectric is lossy for the capacitor application, each is replaced by a separate discrete capacitor 702, such as a chip capacitor or ceramic capacitor with one terminal of one capacitor connected to one resonator and the other shorted to the in-built shielding electrode 730. The same can be done for the other capacitor 724 where one terminal is grounded, i.e., connected to a CPW ground electrode 730 and the other terminal is connected to the resonator section. In addition, a parallel plate/interdigital capacitors 726, 728 are utilized on either side of the first and last resonator elements at the input and output terminals of the device for impedance matching purposes. If greater density is desired multiple thin layers such as the first dielectric layer can be used to form multi (>2) plate capacitors.

The organic bandpass filter 700 may further comprise another monoclad second organic dielectric layer that is laminated on the one side of the first organic dielectric layer (opposite the side of the discrete capacitors). In addition, it may further comprise multiple plate through holes going through first and second organic dielectric layer connected to the in-built shielding electrode 730 and metal sheet of the monoclad dielectric. This may or may not be desired for cost saving purposes, though adding these vias makes it a true CPW/microstrip hybrid device. The CPW topology, where the reference is on the same first organic dielectric layer, provides the shielding internally, and also provides for the ground connectivity to the resonators/inductors and capacitors. However in more noisy environments the external through holes can be added for added shielding.

The organic bandpass filter 700 may further comprise a third organic dielectric layer on the same side as the discrete capacitors 702 providing for protection of the circuits and seal the device from moisture uptake and corrosion. This material could be the same as solder mask materials, which would be used by the board manufacturers to protect other circuits on the board. In addition, the bandpass filter 700 may further comprise a metallic lid or cap/electromagnetic shield which encloses the device on the top surface and prevents EMI interference and radiation effects from affecting the performance of the filter.

FIG. 13 shows model to hardware correlation for the organic bandpass filter 700 in FIG. 12. In particular, FIG. 13 shows a model to hardware correlation for the filter with all embedded components, except the two discrete capacitors. As shown, there is very good agreement between measured and predicted results. The measured filter has a center frequency =1.9 GHz, a 1 dB passband of 60 MHz, and a 3 dB bandwidth of 120 MHz. The attenuation at 1.5 GHz is ~40 dB, as desired. The insertion loss is approximately 3.8 dB at 1.9 GHz, which is greater than the specification of 3 dB for such applications. This is due to the use of center and matching capacitors with Qs of 40 in Vialux rather than the required Q of 60 needed to achieve a lesser loss of 3 dB. This insertion loss can be lowered by using A-PPE™ or LCP™ from Rogers Corporation dielectric materials for the organic dielectric layer. Such a filter would be applicable in cellular phones as the intermediate RF filter or in cordless phones as the front-end RF filter.

As seen in FIG. 13, there is a discrepancy in the measured and predicted results beyond 2.5 GHz for $S_{21}$. This discrepancy is due to the coupling between the two discrete capacitors. The simulations were done for individual components and for optimizing the spacing between the inductors. The discrete capacitors were measured as individual components without any coupling between them. The tight spacing between the capacitors could have resulted in unwanted coupling effects which show up at frequencies greater than 2.5 GHz. After including a mutual coupling term between the two discrete capacitors, the results show better agreement with measurements.

Thus, the organic bandpass filter 700 utilizes a CPW topology with only two metallization levels and an epoxy based substrate along with discrete capacitors, which achieves the performance of non-standardized multilayer (>5) ceramic processes. Additionally, the MLC filters cannot be integrated with other components in the same layers of the ceramic package due to several reasons, a few of which include: firstly, because of the use of a filter-specific dielectric which is incompatible with other dielectrics; secondly, because of the specificity of certain attributes such as 100 μm thick aluminium conductor lines required to lower the attenuation present due to standard 5 μm lines used in ceramic processes. The design discussed in this section was fabricated using standard design rules pertinent to multilayer laminate boards and can be directly implemented on the board without the need for a separate surface mount device. Furthermore, the model to hardware correlation shows validity of the design technique used.

IV. High-Performing Multi-Layer Inductors

In accordance with an embodiment of the present invention, the inductors described above with respect to the bandpass filter may be formed using high-performing multi-layer inductors as described herein. In particular, these high-performing multi-layer inductors may provide for high-Q factors and high current-carrying capabilities. Furthermore, these high-performing multi-layer inductors may be realized in devices other than a bandpass filter, including a stand-alone inductor, a diplexer, a duplexer, a multiplexer, a baluns, a power combiner, a band-stop/band elimination filter, a power divider, a low-pass filter, a high-pass filter, a voltage controlled oscillator (VCO), and a low noise amplifiers (LNA). Other applications of the high-performing multi-layer inductor will be readily apparent to one of ordinary skill in the art. For example, the high-performing multi-layer inductor can be applied to virtually any device that requires an inductor.

Figure 14C:
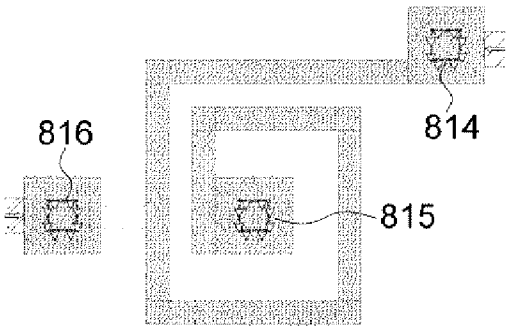
Figure 14D:
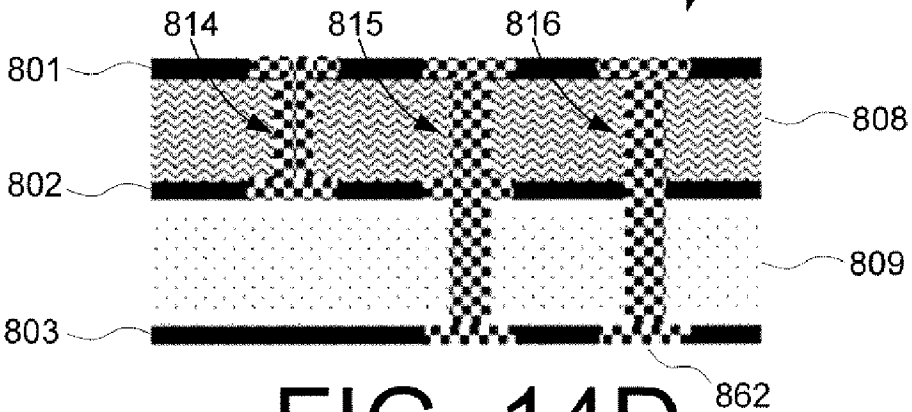
Figure 14A:
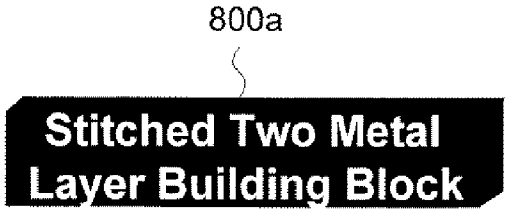
Figure 14B:
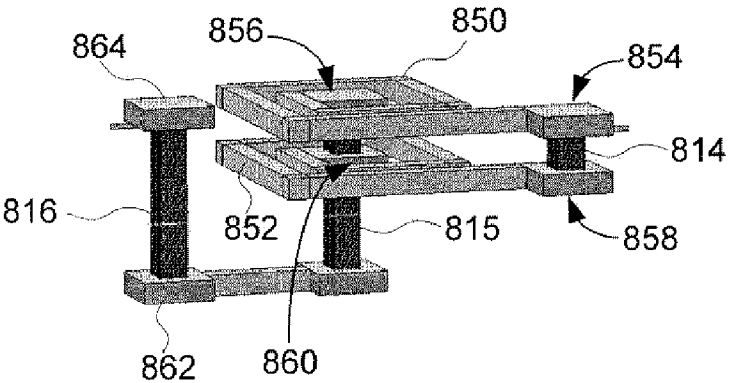

Referring now to FIG. 14A, there is a functional block diagram of a stitched metal layer building block 800*a* that may be utilized in the high-performing inductors described above, according to an exemplary embodiment of the present invention. FIG. 14B illustrates a three-dimensional view of the building block 800*a* of FIG. 14A. In particular, as shown in FIG. 14B, the building block 800*a* may be comprised of a first inductor section 850 and a second inductor section 852. The first inductor section 850 may include a first connection point 854 and a second connection point 856. Likewise, the second inductor section 852 may include a first connection point 858 and a second connection point 860. While the first inductor section 850 and the second inductor section 852 in FIG. 14B each form the shape of a spiral, inductor sections 850, 852 may be a loop, circular, hexagonal, and other polygonal shapes with a variety of complete or partial turns without departing from embodiments of the present invention. In addition, the first inductor section 850 and the second inductor section 852 may be substantially identical in shape and vertically aligned according to an embodiments of the present invention.

As shown in FIG. 14B, the first inductor layer section 850 and the second inductor section 852 may be stitched together to form a single stitched metal layer building block 800*a*. More specifically, according to an exemplary embodiment of the present invention, the first connection point 854 of the first inductor section 850 may be connected or stitched to the first connection point 858 of the second inductor section 852 using a plated via 814. The first connection point 854 can also serve as an input for the building block 800*a*. Similarly, the second connection point 856 of the first inductor section 850 may be connected or stitched to the second connection point 860 of the second inductor section 852 using a plated via 815. In addition, the plated via 815 may further be connected to a routing layer 862. The routing layer 862 may in turn be connected to an output 864 using a plated via 816. Plated vias 814, 815, and 816, which may be microvias, may be created by drilling (e.g., mechanical, laser drilling, etc.) through holes (perhaps as small in diameter as the thickness of the dielectric used) and plating the through holes with a conductive material, such as electroless or seeded copper. Referring to FIG. 14C, the vias 814, 815, and 816 are illustrated in a top plan view of the stitched metal layer building block 800*a*.

FIG. 14D illustrates an exemplary stackup 865 that embodies the stitched metal layer building block 800*a* of FIGS. 14A-14C. In particular, the stackup 865 includes metallization layers 801, 802, and 803, an organic dielectric layer 808, an organic buildup layer 809, and vias 814, 815, 816. The metallization layers 801, 802, and 803, which are formed on the respective organic dielectric layer 808 and organic buildup layer 809, may be conductive layers that are patterned or circuitized as necessary. Thus, the metallization layers 801, 802, and 803 may be formed of copper, nickel, gold, silver, and other metals and alloys. According to an aspect of the present invention, the organic dielectric layer 808 may be formed of liquid crystalline polymer (LCP), although other materials may be utilized, including PPE, N6000, epoxy based N4000-13, bromine-free material laminated to LCP, organic layers with high K material, unfilled high-K organic layers, Rogers 4350, Rogers 4003 material, and other thermoplastic materials such as polyphenylene sulfide resins, polyethylene terephthalate resins, polybutylene terephthalate resins, polyethylene sulfide resins, polyether ketone resins, polytetraflouroethylene resins and graft resins, or similar low dielectric constant, low-loss organic material. In addition, the organic dielectric layer 808 may have a dielectric constant of less than approximately 3.1 and a dielectric loss of less than about 0.004. According to an aspect of the present invention, the organic dielectric layer 808 may also be thin, perhaps less than around 10 mils, although other thicknesses can be utilized. The organic laminate layer 809 may be formed of an organic buildup material such as laminate LCP, although other materials may be utilized, including prepreg, bond ply, or other thermosetting polymer including epoxy resins, phenolic resins, unsaturated polyester resins, phenolic resins, unsaturated polyester resins, polyimide resins, cyanate resins, polyphenylene ether resins, furmate resins, and polybutadiene resins. The organic laminate layer 809 may have a dielectric constant of less than about 3.5 and a dielectric loss of less than about 0.004. Via 814 may connect metallization layers 801 and 802. Via 815 may connect metallization layers 801, 802, and 803. Via 816 may connect metallization layers 801 and 803.

Still referring to FIG. 14D, the first metallization layer 801 may be patterned or circuitized, as described above, to include the first inductor section 850, which includes the first connection point 854 that may serve as the input for the stitched metal layer building block 800*a*. Additionally, the first metallization layer 801 can also be patterned or circuitized to include the output 864 for the stitched metal layer building block 800*b*. Likewise, the second metallization layer 802 can be patterned or circuitized to form the second inductor section 852. Similarly, the third metallization layer 803 can be patterned or circuitized to form the routing layer 862. According to an aspect of the present invention, the trace widths and spaces on the above-described metallization layers may be from a few mils or greater.

The stitched metal layer building block 800*a* comprised of the first and second inductor sections 850 and 852 stitched together may have significant advantages over non-stitched inductor sections. In particular, the stitching of inductor sections 850 and 852 may significantly reduce the DC/RF losses while reduce the inductance value by a substantially lower factor, thereby resulting in an increase in Q-factor. In other words, the parallel connection of the inductor sections 850 and 852 may reduce the resulting resistance at a faster rate than the resulting inductance value.

Figure 15A:
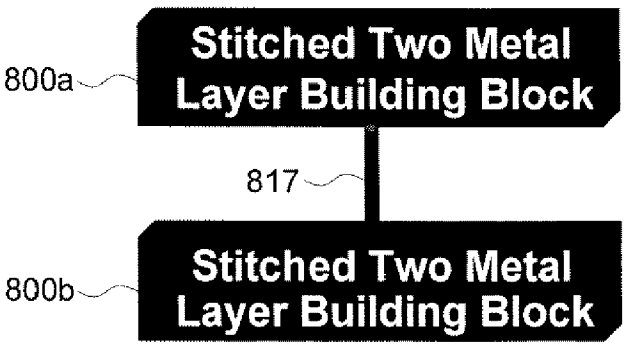

In addition, the stitched metal layer building block 800*a* described above with respect to FIGS. 14A-14D can be incorporated with one or more other stitched metal layer building blocks. For example, referring now to FIG. 15A, there is a functional block diagram of two stitched metal layer building blocks 800*a* and 800*b* that may be utilized in the high-performing inductors described above, according to an exemplary embodiment of the present invention. As shown in FIG. 15A, a first stitched metal layer building block 800*a* may be connected to a second stitched metal layer building block 800*b* by a plated via 817.

Figure 15B:
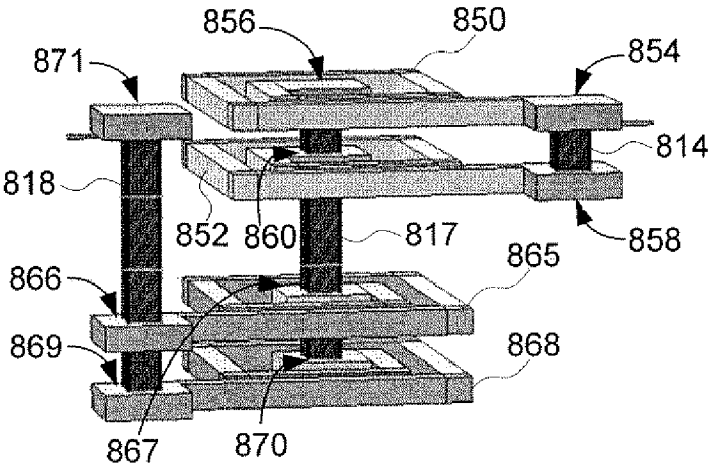

FIG. 15B illustrates a three-dimensional view of the building blocks 800*a* and 800*b* in FIG. 15A. In particular, as shown in FIG. 15B, the building block 800*a* may be comprised of a first inductor section 850 and a second inductor section 852, which may be substantially the same shape and vertically aligned according to an embodiments of the present invention. The first inductor section 850 includes a first connection point 854 and a second connection point 856. The first connection point 854 may provide an input for the multi-layer inductor comprised of the first stitched metal layer building block 800*a* and the second stitched metal layer building block 800*b*. The second inductor section 852 includes a first connection point 858 and a second connection point 860. As shown in FIG. 15B, the first inductor section 850 and the second inductor section 852 are connected or stitched together via plated vias 814 and 817. More specifically, plated via 814 connects or stitches together the first connection point 854 of the first inductor section 850 with the first connection point 858 of the second inductor section 852. Similarly, plated via 817 connects the second connection point 856 of the first inductor section 850 with the second connection point 860 of the second inductor section 852.

Likewise, the second building block 800*b* is also comprised of a third inductor section 865 and a fourth inductor section 868, which may be substantially the same shape and vertically aligned according to an embodiment of the present invention. The third inductor section 865 includes a first connection point 866 and a second connection point 867. The fourth inductor section 868 includes a first connection point 869 and a second connection point 870. As shown in FIG. 15B, the third inductor section 865 and the fourth inductor section 868 are connected or stitched together via plated vias 817 and 818. More specifically, plated via 817 connects or stitches together the second connection point 867 of the third inductor section 865 with the second connection point 870 of the fourth inductor section 868. Similarly, plated via 818 connects the first connection point 866 of the third inductor section 865 with the first connection point 869 of the fourth inductor section 868.

Figure 15C:
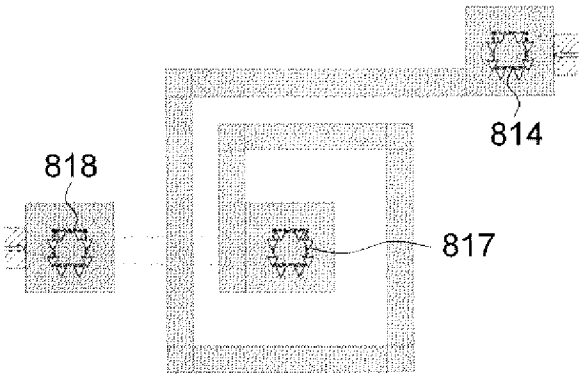

Referring back to FIG. 15A, the plated via 817 connects or stitches the first building block 800*a* with the second building block 800*b*. Thus, as shown in FIG. 15B, plated via 817 connects all of the following: the second connection point 856 of the first inductor section 850 and the second connection point 860 of the second inductor section 852, as well as the second connection point 867 of the third inductor section 865 and the second connection point 870 of the fourth inductor section 868. Further, in addition to connecting the first connection point 866 of the third inductor section 865 with the first connection point 869 of the fourth inductor section 868, the plated via 818 may also provide a connection to the output 871. FIG. 15C illustrates a top plan view of the vias 814, 817, and 818, according to an exemplary embodiment of the present invention.

Figure 15D:
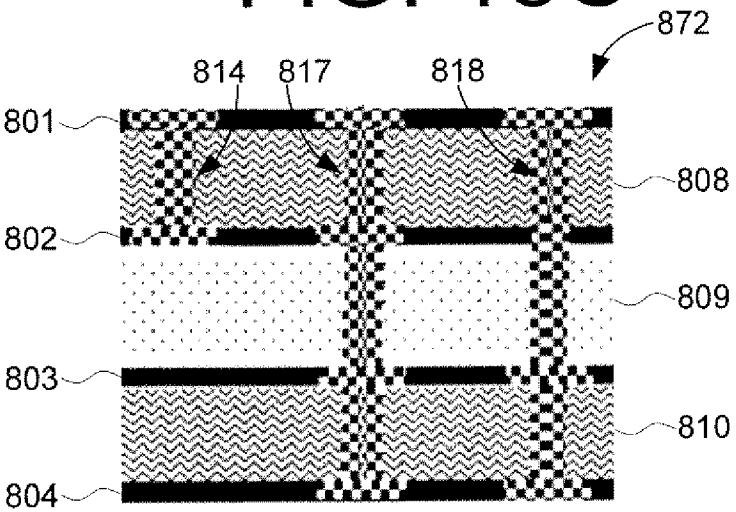

FIG. 15D illustrates an exemplary stackup 872 that embodies the first stitched metal layer building block 800*a* and the second stitched metal layer building block 800*b* of FIGS. 15A-15C. In particular, the stackup 872 includes metallization layers 801, 802, 803, and 804, organic dielectric layers 808 and 810, an organic laminate layer 809, and vias 814, 817, 818. The metallization layers 801, 802, 803 and 804, which are formed on the respective organic dielectric layers 808, 810 and organic laminate layer 809, may be conductive layers that are patterned or circuitized as necessary. Metallization layers 801, 802, 803, and 804 may be formed of the metals and alloys described above, including copper, nickel, gold, and silver. Likewise, the organic dielectric layers 808 and 810 may be formed of liquid crystalline polymer (LCP), although other materials can be ulitized, including PPE, N6000, epoxy based N4000-13, bromine-free material laminated to LCP, organic layers with high K material, unfilled high-K organic layers, Rogers 4350, Rogers 4003 material, and other theremoplastic materials such as polyphenylene sulfide resins, polyethylene terephthalate resins, polybutylene terephthalate resins, polyethylene sulfide resins, polyether ketone resins, polytetraflouroethylene resins and graft resins, or similar low dielectric constant, low-loss organic material. The organic dielectric layers 808 and 810 may have a dielectric constant of less than approximately 3.1 and a dielectric loss of less than about 0.004. The organic laminate layer 809 may be formed of an organic buildup material such as laminate LCP, although other materials may be utilized, including prepreg, bond ply, or other thermosetting polymer including epoxy resins, phenolic resins, unsaturated polyester resins, phenolic resins, unsaturated polyester resins, polyimide resins, cyanate resins, polyphenylene ether resins, furmate resins, and polybutadiene resins. The organic laminate layer 809 may have a dielectric constant of less than about 3.5 and a dielectric loss of less than about 0.004. Via 814 may connect metallization layers 801 and 802. Via 817 may connect metallization layers 801, 802, 803, and 804. Via 818 may connect metallization layers 801, 803, and 804.

Still referring to FIG. 15D, the metallization layer 801 may be patterned or circuitized to include the first inductor section 850, which includes the first connection point 854 that may serve as the input for the combined first stitched metal layer building block 800*a* and second stitched metal layer building block 800*b*. Additionally, metallization layer 801 can also be patterned or circuitized to include the output 871 for the combined first stitched metal layer building block 800*a* and second stitched metal layer building block 800*b*. Likewise, the metallization layer 802 can be patterned or circuitized to form the second inductor section 852. Similarly, the metallization layer 803 can be patterned or circuitized to form the third inductor section 865. In addition, the fourth metallization layer 804 can be patterned or circuitized to form the fourth inductor section 868.

The cascading of the plurality of stitched metal layer building blocks as described above may be utilized if the inductance value of the a single metal layer building block is insufficient for the intended application. Generally, the resulting inductance can be increased by including additional stitched metal layer building blocks. In addition, the cascading of the plurality of stitched metal layers in the vertical direction may be utilized if horizontal space constraints exist. On the other hand, as will be described in other embodiments below, the plurality of stitched metal layers can be connected horizontally if vertical space constraints exist.

Figure 16A:
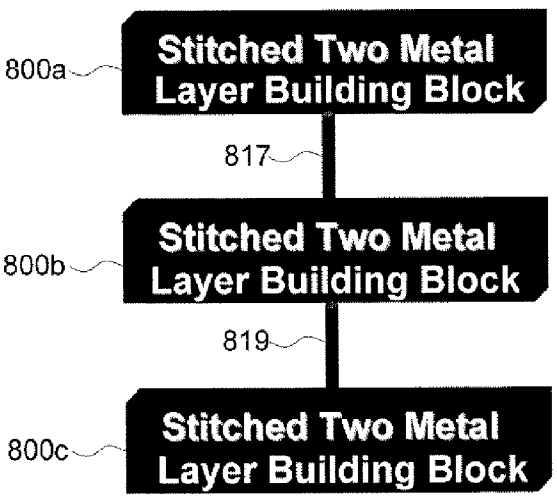

Referring now to FIG. 16A, there is a functional block diagram of three stitched metal layer building blocks 800*a*, 800*b*, and 800*c* that may be utilized in the high-performing inductors described above, according to an exemplary embodiment of the present invention. As shown in FIG. 16A, a first stitched metal layer building block 800*a* may be connected to a second stitched metal layer building block 800*b* by a plated via 817. Likewise, the second stitched metal layer building block 800*b* may be connected to the third stitched metal layer building block 800*c* by a plated via 819.

Figure 16B:
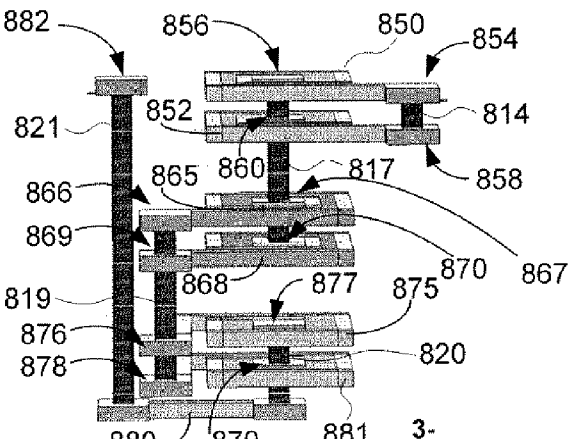

FIG. 16B illustrates a three-dimensional view of the stitched metal layer building blocks 800*a*, 800*b*, and 800*c* in FIG. 16A. The building block 800*a* may be comprised of a first inductor section 850 and a second inductor section 852, which may be substantially the same shape and vertically aligned according to an embodiment of the present invention. The first inductor section 850 includes a first connection point 854 and a second connection point 856. The second inductor section 852 also includes a first connection point 858 and a second connection point 860. As shown in FIG. 161, plated via 814 connects or stitches together the first connection point 854 of the first inductor section 850 with the first connection point 858 of the second inductor section 852. Similarly, plated via 817 connects the second connection point 856 of the first inductor section 850 with the second connection point 860 of the second inductor section 852.

Likewise, the second building block 800*b* is also comprised of a third inductor section 865 and a fourth inductor section 868, which may also be substantially the same shape and vertically aligned, according to an embodiment of the present invention. The third inductor section 865 includes a first connection point 866 and a second connection point 867. The fourth inductor section 868 also includes a first connection point 869 and a second connection point 870. As shown in FIG. 15B, plated via 817 also connects or stitches together the second connection point 867 of the third inductor section 865 with the second connection point 870 of the fourth inductor section 868. Similarly, plated via 819 connects the first connection point 866 of the third inductor section 865 with the first connection point 869 of the fourth inductor section 868.

In addition, the third building block 800*c* is comprised of a fifth inductor section 875 and a sixth inductor section 881, which may also be substantially the same shape and vertically aligned according to an embodiment of the present invention. Both the fifth inductor section 875 and the sixth inductor section 881 include respective first connection points 876 and 878 as well as respective second connection points 877 and 879. As shown in FIG. 161, plated via 819 also connects or stitches together the first connection point 876 of the fifth inductor section 875 with the first connection point 878 of the sixth inductor section 881. Similarly, plated via 820 connects the second connection point 877 of the fifth inductor section 875 with the second connection point 879 of the sixth inductor section 881.

Figure 16C:
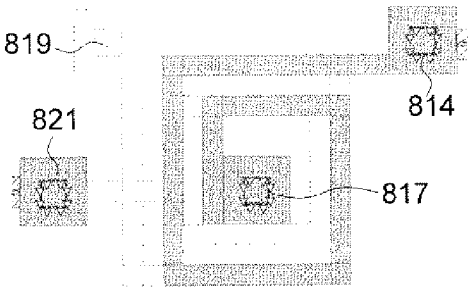

Referring back to FIG. 16A, the plated via 817 also connects or stitches the first building block 800*a* with the second building block 800*b*. Thus, as shown in FIG. 16B, plated via 817 connects all of the following: the second connection point 856 of the first inductor section 850 and the second connection point 860 of the second inductor section 852, as well as the second connection point 867 of the third inductor section 865 and the second connection point 870 of the fourth inductor section 868. In addition, the plated via 819 also connects or stitches together the second building block 800*b* with the third building block 800*c*. Thus, in addition to connecting the first connection point 866 of the third inductor section 865 with the first connection point 869 of the fourth inductor section 868, the plated via 819 may also be connected to the first connection point 876 of the fifth inductor section 875 and the first connection point 878 of the sixth inductor section 881. Still further, the plated via 820 may connect the second connection points 877 and 879 of the respective fifth and sixth inductor sections 875 and 881 with the routing section 880. The routing section 880 may provide a connection to the output 882 through the plated via 821. FIG. 16C illustrates a top plan view of the vias 814, 817, 819, and 821 according to an exemplary embodiment of the present invention.

Figure 16D:
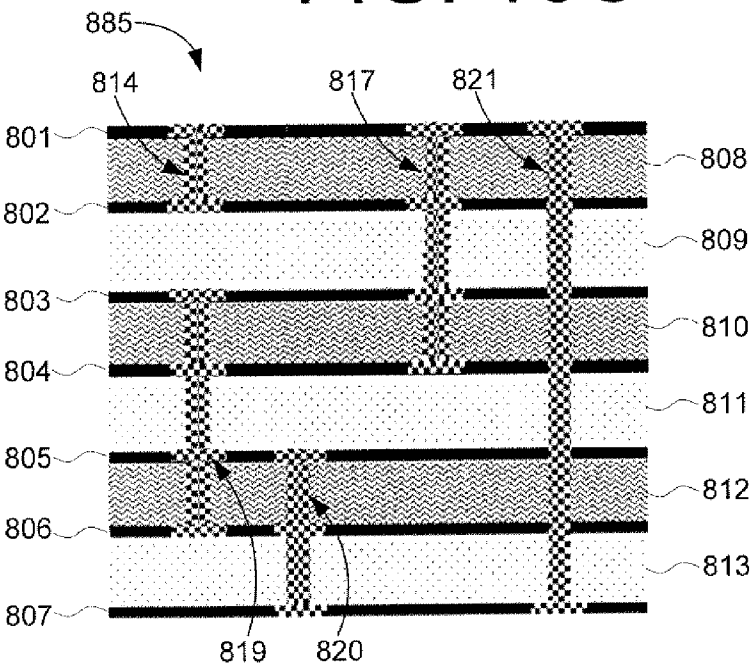

FIG. 16D illustrates an exemplary stackup 885 that embodies the first stitched metal layer building block 800*a*, the second stitched metal layer building block 800*b*, and the third stitched metal layer building block 800*c* of FIGS. 16A-16C. In particular, the stackup 885 includes metallization layers 801, 802, 803, 804, 805, 806, and 807 organic dielectric layers 808, 810, and 812, organic laminate layers 809, 811, and 813, and vias 814, 817, 819, 820, and 821. The metallization layers 801, 802, 803, 804, 805, 806, and 807 which are formed on the respective organic dielectric layers 808, 810, 812 and organic buildup layer 809, 811, 813 may be conductive layers that are patterned or circuitized as necessary. Thus, the metallization layers 801, 802, 803, 804, 805, 806, and 807 may be formed of copper, nickel, gold, silver, and other metals and alloys. The organic dielectric layers 808, 810, and 812 may be formed of liquid crystalline polymer (LCP), although other material may be utilized, including PPE, N6000, epoxy based N4000-13, bromine-free material laminated to LCP, organic layers with high K material, unfilled high-K organic layers, Rogers 4350, Rogers 4003 material, and other thermoplastic materials such as polyphenylene sulfide resins, polyethylene terephthalate resins, polybutylene terephthalate resins, polyethylene sulfide resins, polyether ketone resins, polytetraflouroethylene resins and graft resins, or similar low dielectric constant, low-loss organic material. The organic dielectric layers 808, 810, and 812 may have a dielectric constant of less than approximately 3.1 and a dielectric loss of less than about 0.004. The organic laminate layers 809, 811, and 813, which may be formed of an organic buildup material such as laminate LCP, although other materials may be utilized, including prepreg, bond ply, or other thermosetting polymer including epoxy resins, phenolic resins, unsaturated polyester resins, phenolic resins, unsaturated polyester resins, polyimide resins, cyanate resins, polyphenylene ether resins, furmate resins, and polybutadiene resins. The organic laminate layers 809, 811, and 813 may have a dielectric constant of less than about 3.5 and a dielectric loss of less than about 0.004. Via 814 may connect metallization layers 801 and 802. Via 817 may connect metallization layers 801, 802, 803, and 804. Via 819 may connect metallization layers 803, 804, 805, and 806. Via 820 may connect metallization layers 805, 806, and 807. Likewise, via 821 may connect metallization layers 801 and 807.

Still referring to FIG. 16D, the metallization layer 801 may be patterned or circuitized to include the first inductor section 850, which includes the first connection point 854 that may serve as the input for the combined first stitched metal layer building block 800*a* and second stitched metal layer building block 800*b*. Additionally, metallization layer 801 can also be patterned or circuitized to include the output 871 for the combined first stitched metal layer building block 800*a*, second stitched metal layer building block 800*b*, and the third stitched metal layer building block 800*c*. Likewise, the metallization layer 802 can be patterned or circuitized to form the second inductor section 852. Similarly, the metallization layer 803 can be patterned or circuitized to form the third inductor section 865. The fourth metallization layer 804 can be patterned or circuitized to form the fourth inductor section 868. The fifth metallization layer 805 can be patterned or circuitized to form the fifth inductor section 875. Likewise, the sixth metallization layer 806 can be patterned or circuitized to form the sixth inductor section 881. Further, the seventh metallization layer 807 can be patterned or circuitized to form the routing section 880.

One of ordinary skill in the art will recognize that the patterning and circuitization of the metallization layers described above can vary without departing from embodiments of the present invention. For example, the trace width and spacing on the metallization layers can vary from a few mils to significantly more mils. In addition, the thickness of the organic dielectric layers and buildup layers can also be varied without departing from embodiments of the present invention. For example, the thickness may vary from tens of microns to multiple millimeters.

FIG. 17 is a functional block diagram that extends the stitched metal layer building blocks described with respect to FIGS. 14A-16D by adding additional vertical connections of stitched metal layer building blocks. For example, in addition to the stitched metal layer building blocks 800*a-c* described with respect to FIG. 16A-D, there can be n numbers of stitched metal layer building blocks.

FIG. 18A is a functional block diagram that provides both vertical connections and horizontal connections for stitched metal layer building blocks. For example, FIG. 18 illustrates stitched metal layer building blocks 900*a*, 900*b*, 900*c*, and 900*d*. As shown in FIG. 18, a first stitched metal layer building block 900*a* may be horizontally aligned and connected to a second stitched metal layer building block 900*b* by plated vias 915. In addition, a third stitched metal layer building block 900*c* may be vertically connected to the first and second building blocks 900*a* and 900*b* by plated via 917. Further, a fourth metal layer building block 900*d* may be vertically connected to the first and second building blocks 900*a* and 900*b* by plated vias 919 and 920.

FIG. 18B illustrates a three-dimensional view of the building blocks 900*a*, 900*b*, 900*c*, and 900*d* in FIG. 18A. As shown in FIG. 18B, the first stitched metal layer building block 900*a* includes a first inductor section 950 and second inductor section 951. The first and second inductor sections 950, 951 include respective first connection points 925, 927 and respective connection points 926, 928. In addition, the second stitched metal layer building block 900*b* includes a first inductor section 952 and a second inductor section 953. The first and second inductor sections 952, 953 include respective first connection points 929, 931 and respective second connection points 930, 932. Similarly, the third stitched metal layer building block 900*c* includes a first inductor section 954 and second inductor section 955. The first and second inductor sections 954, 955 include respective first connection points 933, 935 and second connection points 934, 936. Likewise, the fourth stitched metal layer building block 900*d* includes a first inductor section 956 and a second inductor section 957. The first and second inductor sections 956, 957 include respective first connection points 937, 939 and respective second connection points 938, 940.

As described above, the first metal layer building block 900*a* may be aligned horizontally with the second metal layer building block 900*b*. Still referring to FIG. 18B, the plated via 915 may connect the second connection points 926, 928 associated with the first metal layer building block 900*a* with the second connection points 930, 932 associated with the second metal layer building block 900*b*. In addition, the plated via 919 may connect the first connection points 925, 927 associated with the first metal layer building block 900*a* with the first connection points 929, 931 associated with the second metal layer building block 900*b*.

As also described above, one or more of the third and fourth metal layer building blocks 900*c* and 900*d* may be connected to the first and second metal layer building blocks 900*a* and 900*b*. Referring to FIG. 18B, a plated via 917 may connect the second connection points 934, 936 associated with the third metal layer building block 900*c* to the plated via 915, thereby providing a vertical connection between the third metal layer building block 900*c* and the first and second metal layer building blocks 900*a* and 900*b*. A plated via 916 may connect the first connection points 933 and 935 associated with the third metal layer building block 900*c*. In addition, a plated via 920 may connect the second connection points 938, 940 associated with the fourth metal layer building block 900*d* to the plated via 919, thereby providing a vertical connection between the fourth metal layer building block 900*d* and the first and second metal layer building blocks 900*a* and 900*b*. Further, a plated via 918 may connect the first connection points 937 and 939 associated with the fourth metal layer building blocks 900*d*.

In accordance with an embodiment of the present invention, the first and second building blocks 900*a* and 900*b* may be formed on a first organic dielectric layer having conductive layers on two opposing surfaces, where the conductive layers can be patterned or circuitized to form the first inductor sections 950 and 952 as well as the second inductor sections 951 and 953. The third building block 900*c* may be formed on a second organic dielectric layer having conductive layers on two opposing surfaces, where the conductive layers can be patterned or circuitized to form the first inductor section 954 and second inductor section 955. Likewise, the fourth building block 900*d* may be formed on a third organic dielectric layer having conductive layers on two opposing surfaces, where the conductive layers can be patterned or circuitized to form the first inductor section 956 and the second inductor section 957. In addition, one or more organic laminate layers may be disposed between the first organic dielectric layer and the second organic dielectric layer as well as the second organic dielectric layer and the third organic dielectric layer. The first, second, and third organic dielectric layers may be formed of LCP, although other materials can be ulitized, including PPE, N6000, epoxy based N4000-13, bromine-free material laminated to LCP, organic layers with high K material, unfilled high-K organic layers, Rogers 4350, Rogers 4003 material, and other theremoplastic materials such as polyphenylene sulfide resins, polyethylene terephthalate resins, polybutylene terephthalate resins, polyethylene sulfide resins, polyether ketone resins, polytetraflouroethylene resins and graft resins, or similar low dielectric constant, low-loss organic material. In addition, the organic laminate layers may also be formed of laminate LCP, although other materials may be utilized, including prepreg, bond ply, or other thermosetting polymer including epoxy resins, phenolic resins, unsaturated polyester resins, phenolic resins, unsaturated polyester resins, polyimide resins, cyanate resins, polyphenylene ether resins, furmate resins, and polybutadiene resins.

One of ordinary skill in the art will recognize that the horizontal and/or vertical positioning of the metal layer building blocks described above can be configured to optimize the quality factor, current-carrying capability of the resulting high-performance inductors. In addition, the horizontal and/or vertical configurations described above can be varied in order to provide a particular footprint and/or area. Furthermore, the horizontal and/or vertical configurations may be selected in order to optimize the fabrication yield.

In addition, the exemplary stitched metal layer building blocks have been described with respect to two-metal layers. However, other stitched metal layer building blocks may include more than two-metal layers, including three metal layers. With three metal layers, there may be a first inductor section, a second inductor section, and a third inductor section that are vertically aligned with each other. The first connection points of the first, second, and third inductor sections may be stitched or connected together by a first plated via. Likewise, the second connection points of the first, second, and third inductor sections may be stitched or connected together by a second plated via.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An organic inductor, comprising:

a first organic layer having a first surface and a second surface opposite the first surface;

a first conductive layer on the first surface of the first organic layer, wherein the first conductive layer is patterned to form a first inductor section having a first connection point and a second connection point;

a second conductive layer on the second surface of the first organic layer, wherein the second conductive layer is patterned to form a second inductor section having a first connection point and a second connection point;

a first via connecting the first connection point of the first inductor section with the first connection point of the second inductor section, wherein the first via is provided through the first organic layer; and a second via connecting the second connection point of the first inductor section with the second connection point of the second inductor, wherein the second via is provided through the first organic layer.

2. The organic inductor of claim 1, further comprising:

a second organic layer having a first surface and a second surface opposite the first surface;

an organic laminate layer disposed between the first organic layer and the second organic layer;

a third conductive layer on a first surface of the second organic layer, wherein the third conductive layer is patterned to form a third inductor section having a first connection point and a second connection point;

a fourth conductive layer on a second surface of the second organic layer, wherein the fourth conductive layer is patterned to form a fourth inductor section having a first connection point and a second connection point, wherein the second via further connects the second connection point of the third inductor section and the second connection point of the fourth inductor section, wherein the second via is further provided through the organic laminate layer and the second organic layer; and a third via connecting the first connection point of the third inductor section with the first connection point of the fourth inductor section, wherein the third via is provided through the second organic layer.

3. The organic inductor of claim 2, wherein one or more of the first organic layer, the second organic layer, and the organic laminate layer comprise liquid crystalline polymer (LCP).

4. The organic inductor of claim 2, wherein one or both of the first organic layer and the second organic layer are low-loss.

5. The organic inductor of claim 2, wherein the first and second inductor sections are substantially identical in shape, and wherein the third and fourth inductor sections are substantially identical in shape.

6. The organic inductor of claim 5, wherein the shape is one of spiral, loop, circular, or hexagonal.

7. The organic inductor of claim 5, wherein the first and second inductor sections are vertically aligned and wherein the third and fourth inductor sections are vertically aligned.

8. The organic inductor of claim 1, wherein the first, second, third, and fourth inductor sections include one or more complete or partial turns.

9. An organic inductor, comprising:

a first organic layer having a first surface and a second surface opposite the first surface;

a first conductive layer on the first surface of the first organic layer, wherein the first conductive layer is patterned to form a first inductor section having a first connection point and a second connection point, and a second inductor section having a first connection point and a second connection point;

a second conductive layer on the second surface of the first organic layer, wherein the second conductive layer is patterned to form a third inductor section having a first connection point and a second connection point, and a fourth inductor section having a first connection point and a second connection point; and at least one first via connecting the second connection points of the first inductor section, the second inductor section, the third inductor section, and the fourth inductor section, wherein the at least one first via is provided through the first organic layer;

at least one second via connecting the first connection point of the first inductor section and the first connection point of the third inductor section, wherein the at least one second via is provided through the first organic layer; and at least one third via connecting the first connection point of the second inductor section and the first connection point of the fourth inductor section, wherein the at least one third via is provided through the first organic layer.

10. The organic inductor of claim 9, wherein the first inductor section and the third inductor section are substantially identical in shape, and wherein the second inductor section and the fourth inductor section are substantially identical in shape.

11. The organic inductor of claim 10, wherein the first inductor section and the third inductor section are vertically aligned, and wherein the second inductor section and the fourth inductor section are vertically aligned.

12. The organic inductor of claim 9, further comprising:

a second organic layer having a first surface and a second surface opposite the first surface;

an organic laminate layer disposed between the first organic layer and the second organic layer;

a third conductive layer on the first surface of the second organic layer, wherein the third conductive layer is patterned to form a fifth inductor section having a first connection point and a second connection point;

a fourth conductive layer on the second surface of the second organic layer, wherein the fourth conductive layer is patterned to form a sixth inductor section having a first connection point and a second connection point;

at least one fourth via connecting the first connection point of the fifth inductor section and the first connection point of the sixth inductor section, wherein the at least one fourth via is provided through the second organic layer; and at least one fifth via connecting the second connection point of the fifth inductor section and the second connection point of the sixth inductor section, wherein the at least one fifth via is provided through the second organic layer.

13. The organic inductor of claim 12, wherein the at least one fifth via provides a connection to either (i) the at least one first via or (ii) the at least one second via and the at least one third via.

14. The organic inductor of claim 9, wherein the first organic layer comprises liquid crystalline polymer (LCP).

15. The organic inductor of claim 12, wherein one or more of the first organic layer, the second organic layer, and the organic laminate layer comprise liquid crystalline polymer (LCP).

16. A method for fabricating a high-performing inductor, comprising:

providing a first organic layer having a first conductive layer on a first surface and a second conductive layer on a second surface opposite the first surface;

circuitizing the first conductive layer to form a first inductor section having a first connection point and a second connection point;

circuitizing the second conductive layer to form a second inductor section having a first connection point;

establishing a first via connection between the first connection point of the first inductor section and the first connection point of the second inductor section, wherein the first via connection is provided through the first organic layer; and establishing a second via connection between the second connection point of the first inductor section and the second connection point of the second inductor section, wherein the second via connection is provided through the first organic layer.

17. The method of claim 16, further comprising:

providing a second organic layer having a third conductive layer and a fourth conductive layer;

circuitizing the third conductive layer to form a third inductor section having a first connection point and a second connection point;

circuitizing the fourth conductive layer to form a fourth inductor section having a first connection point and a second connection point; and establishing a third via connection between the first connection point of the third inductor section and the first connection point of the fourth inductor section, wherein the third via connection is provided through the second organic layer, wherein the second via connection further connects the second connection point of the third inductor section and the second connection point of the fourth inductor section, wherein the second via connection is further provided through the organic laminate layer and the second organic layer.

18. The method of claim 17, wherein providing a first organic layer includes providing a first liquid crystalline polymer (LCP) layer, wherein providing a second organic layer includes providing a second LCP layer, and wherein providing an organic laminate layer includes providing an LCP laminate layer.

19. The method of claim 16, wherein the first and second inductor sections are substantially identical in shape, and wherein the first and second inductor sections are vertically aligned.

20. The method of claim 19, wherein the shape is one of spiral, loop, circular, or hexagonal.

* * * * *